US008316676B2

(12) United States Patent
Chiang et al.

(10) Patent No.: US 8,316,676 B2
(45) Date of Patent: Nov. 27, 2012

(54) RE-KEYABLE CYLINDER LOCK

(75) Inventors: Wei-Liang Chiang, Chiayi (TW); Ju-Lin Yang, Chiayi County (TW); Cheng-Chung Liu, Chiayi County (TW); Kun-Chen Lee, Chiayi County (TW); Song-Gen Shyu, Chiayi County (TW); Ching-Chuan Kuo, Chiayi County (TW)

(73) Assignee: Tong Lung Metal Industry Co., Ltd., Chia-Yi (TW)

( * ) Notice: Subject to any disclaimer, the term of this patent is extended or adjusted under 35 U.S.C. 154(b) by 364 days.

(21) Appl. No.: 12/548,605

(22) Filed: Aug. 27, 2009

(65) Prior Publication Data

US 2010/0050717 A1 Mar. 4, 2010

(30) Foreign Application Priority Data

Aug. 29, 2008 (TW) ..... 97133519 A
Dec. 5, 2008 (TW) ..... 97221933 U

(51) Int. Cl.
*E05B 29/04* (2006.01)

(52) U.S. Cl. ..... 70/383; 70/379 R; 70/384; 70/492; 70/495

(58) Field of Classification Search ..... 70/358, 70/419, 421, 422, DIG. 42, 492–496, 368, 70/337–343, 382–385, 379 R, 379 A, 380
See application file for complete search history.

(56) References Cited

U.S. PATENT DOCUMENTS 3,990,282 A * 11/1976 Sorum ..... 70/495
4,966,021 A * 10/1990 Boag ..... 70/383
5,826,451 A * 10/1998 Cook ..... 70/495
6,119,495 A * 9/2000 Loreti ..... 70/340
6,959,569 B2 * 11/2005 Strader et al. ..... 70/492
6,968,717 B2 * 11/2005 Suzuki et al. ..... 70/492
6,973,813 B2 * 12/2005 Erdely ..... 70/492
7,007,528 B2 * 3/2006 Chong et al. ..... 70/492
7,047,778 B2 * 5/2006 Dimig et al. ..... 70/495
7,448,239 B1 * 11/2008 Huang et al. ..... 70/360
7,448,240 B1 * 11/2008 Huang et al. ..... 70/492
7,526,935 B2 * 5/2009 Huang et al. ..... 70/360
7,624,606 B1 * 12/2009 Huang et al. ..... 70/338
7,628,048 B2 * 12/2009 Huang et al. ..... 70/338
7,634,930 B2 * 12/2009 Boesel et al. ..... 70/383
7,836,739 B2 * 11/2010 Huang et al. ..... 70/360
7,874,191 B2 * 1/2011 Chiang et al. ..... 70/492
7,900,491 B2 * 3/2011 Chong ..... 70/492
7,937,976 B2 * 5/2011 Huang et al. ..... 70/338
7,975,518 B2 * 7/2011 Chiang et al. ..... 70/383
7,980,104 B1 * 7/2011 Huang ..... 70/338
7,980,106 B2 * 7/2011 Huang et al. ..... 70/383
8,056,378 B2 * 11/2011 Huang et al. ..... 70/338
8,074,480 B2 * 12/2011 Huang et al. ..... 70/383
8,099,988 B1 * 1/2012 Wheatland ..... 70/383
2004/0069030 A1 * 4/2004 Takadama ..... 70/495
2009/0277236 A1 * 11/2009 Huang et al. ..... 70/368
2011/0011139 A1 * 1/2011 Marcelle et al. ..... 70/372

* cited by examiner

*Primary Examiner* — Lloyd Gall

(74) *Attorney, Agent, or Firm* — Chun-Ming Shih

(57) ABSTRACT

A re-keyable cylinder lock has a control member to permit or restrict transverse movement of a re-keying unit. The control member is movable axially between first and second positions and transversely to a third position from the second position. In the third position, the re-keying unit moves transversely and disengages from first tumbler pieces. A limit member is provided to prevent the control member from moving axially when no right key is inserted into a plug. A security arm is connected to the control member and is breakable so that destructive forces cannot reach the control member.

23 Claims, 25 Drawing Sheets

RE-KEYABLE CYLINDER LOCK

CROSS-REFERENCE TO RELATED APPLICATION

This application claims priority of Taiwanese Invention Patent Application No. 097133519 filed on Aug. 29, 2008, and Taiwanese Utility Model Patent Application No. 097221933 filed on Dec. 5, 2008,

BACKGROUND OF THE INVENTION

1. Field of the Invention

This application relates to a cylinder lock, more particularly to a re-keyable cylinder lock.

2. Description of the Related Art

Traditionally, when it is necessary to re-key a lock mounted on a door, the lock is detached from the door to disassemble a plug from the lock and to exchange tumbler is pins of the plug so as to match a new key. After exchange of the tumbler pins, the lock is re-assembled and re-installed on the door. However, disassembly and re-assembly of the lock and exchange of the tumbler pins require a certain level of skill and knowledge with respect to the construction of the lock, and are usually done by a locksmith or a skilled worker with the use of special tools. The traditional method of re-keying is therefore inconvenient.

SUMMARY OF THE INVENTION

An object of the invention is to provide a novel cylinder lock that has a tumbler piece engaged releasably with a gear wheel.

According to one aspect of the invention, a re-keyable cylinder lock comprises: a lock housing defining a longitudinal axis; a plug disposed within the lock housing, and including a first tumbler piece that has a toothed part; a re-keying unit engaging releasably the toothed part and movable transversely of the longitudinal axis so as to engage or disengage from the toothed part; and a control member disposed inside the lock housing to permit or restrict transverse movement of the re-keying unit. The control member is movable axially between a first position and a second position. The control member moves transversely to a third position from the second position. The re-keying unit moves transversely away from the toothed part when the control member moves transversely.

According to another aspect of the invention, a re-keyable cylinder lock comprises: a lock housing; a plug disposed in the lock housing and having a first tumbler piece that has a toothed part; a re-keying unit engaging the toothed part and movable to disengage from the toothed part; and a control member disposed inside the lock housing to permit or restrict a movement of the re-keying unit. The control member has a security arm that projects from a front end of the control member near a front end of the lock housing, and that is operable manually through the front end of the lock housing to move the control member so that the re-keying unit is permitted to disengage from the toothed part. The security arm is breakable to separate from the front end of the control member, thereby preventing an external force from reaching the control member.

According to further aspect of the invention, a re-keyable cylinder lock comprises: a lock housing having a plug hole, and a retaining hole proximate to the plug hole; a plug disposed in the plug hole within the lock housing, and including a key hole, a first tumbler piece that has a toothed part, and a second tumbler piece that is disposed near an end of the key hole; and a re-keying unit engaging the toothed part and movable to disengage from the toothed part. The second tumbler piece has a central aperture for extension of a key, a retaining pin disposed on one side of the central aperture, a spring sleeved around the retaining pin, and an engaging end opposite to the retaining pin and biased by the spring to engage the retaining hole of the lock housing, thereby preventing the plug from rotating relative to the lock housing.

BRIEF DESCRIPTION OF THE DRAWINGS

Other features and advantages of the present invention will become apparent in the following detailed description of the preferred embodiments of the invention, with reference to the accompanying drawings, in which.

DETAILED DESCRIPTION OF THE PREFERRED EMBODIMENTS

Figure 1:
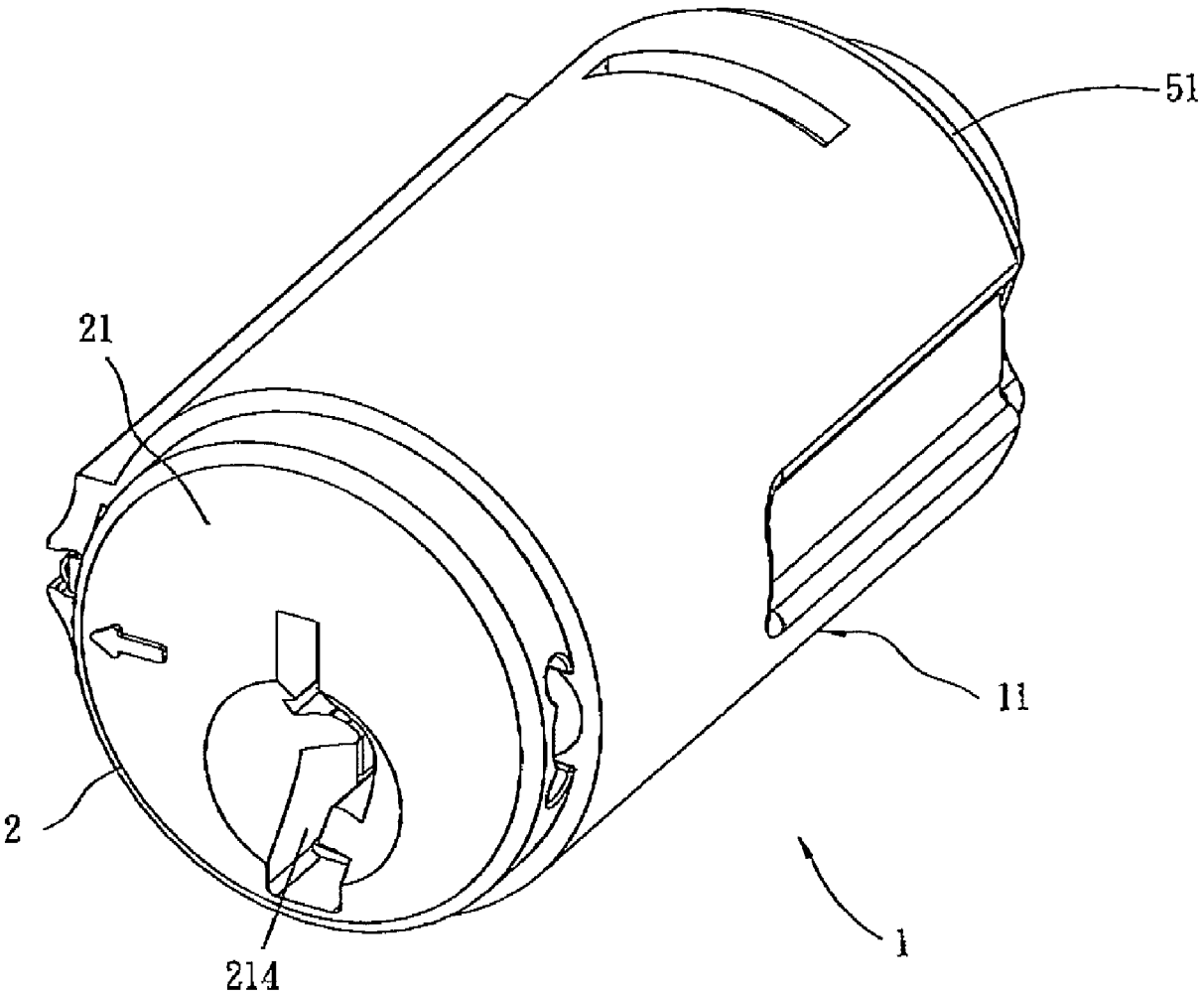
FIG. 1 is a perspective view of a re-keyable cylinder lock according to a first preferred embodiment of the present invention.

Before the present invention is described in greater detail, it should be noted that same reference numerals have been used to denote like elements throughout the specification.

Figure 2:
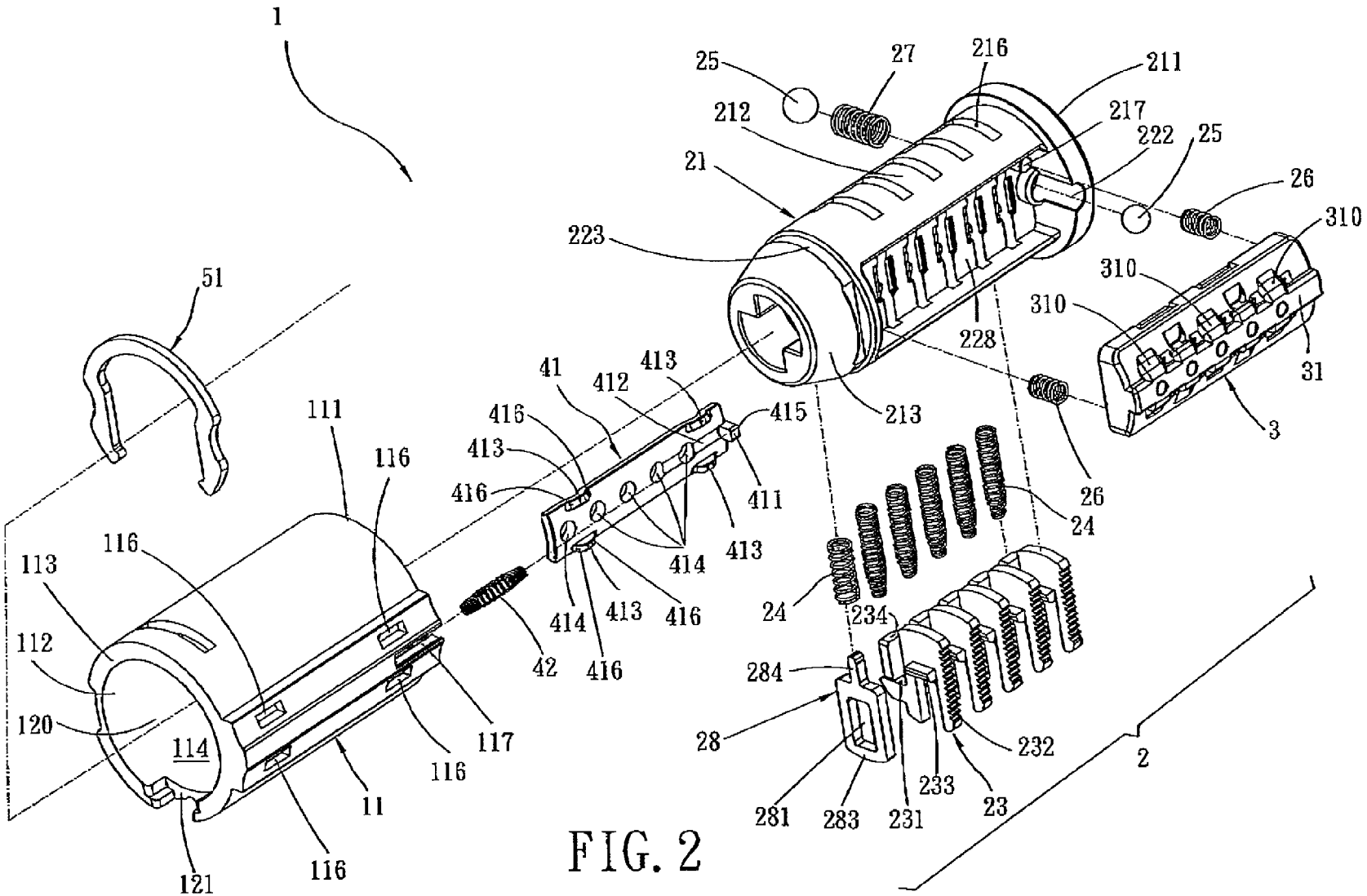
FIG. 2 is an exploded view of the re-keyable cylinder lock.

Referring to FIGS. 1, and 2, there is shown a re-keyable cylinder lock 1 according to a first preferred embodiment of the present invention which comprises a lock housing 11, a plug assembly 2, a control member 41, a spring 42, and a retaining ring 51.

Figure 3:
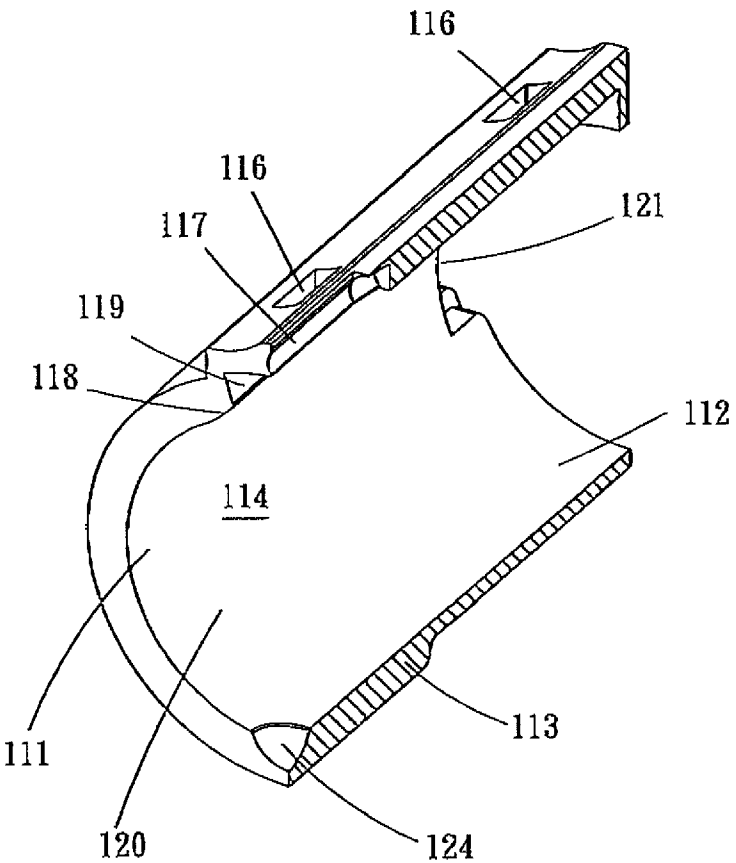
FIG. 3 is a fragmentary perspective view of a lock housing of the re-keyable cylinder lock.
Figure 6:
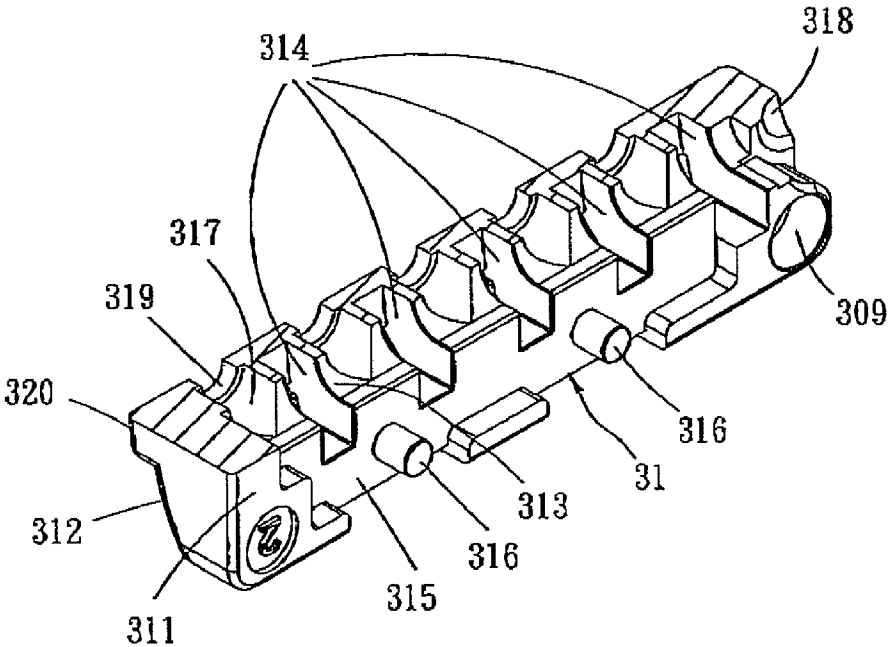
FIG. 6 is a fragmentary perspective view of a gear holder of a re-keying unit of the re-keyable cylinder lock.

Referring to FIG. 3 in combination with FIG. 2, the lock housing 11 has a cylindrical wall 113 with first and second ends 111 and 112. The cylindrical wall 113 has an inner surface 114 confining a cylindrical plug hole 120, a cavity 119 disposed in juxtaposition to the plug hole 120 and extending longitudinally from the first end 111 to the second end 112, a spring space 117, and four guide holes 116. The cavity 119 opens at the first end 111. A quartered spherical shaped recess 124 is formed at the first end 111.

Figure 4:
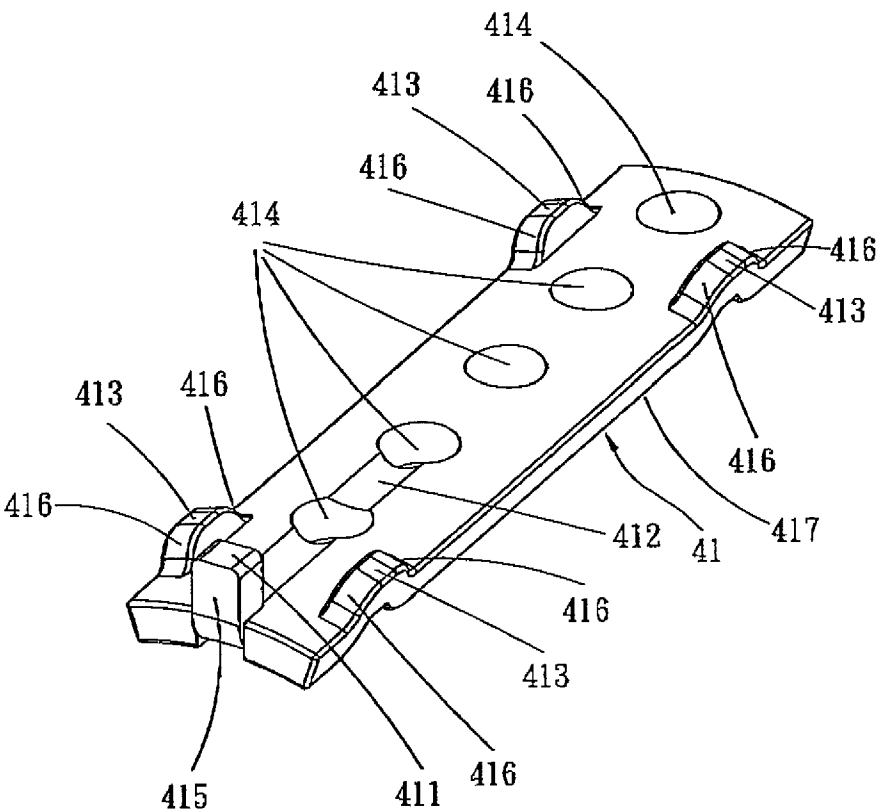
FIG. 4 is a perspective view of a control member of the re-keyable cylinder lock.
Figure 5:
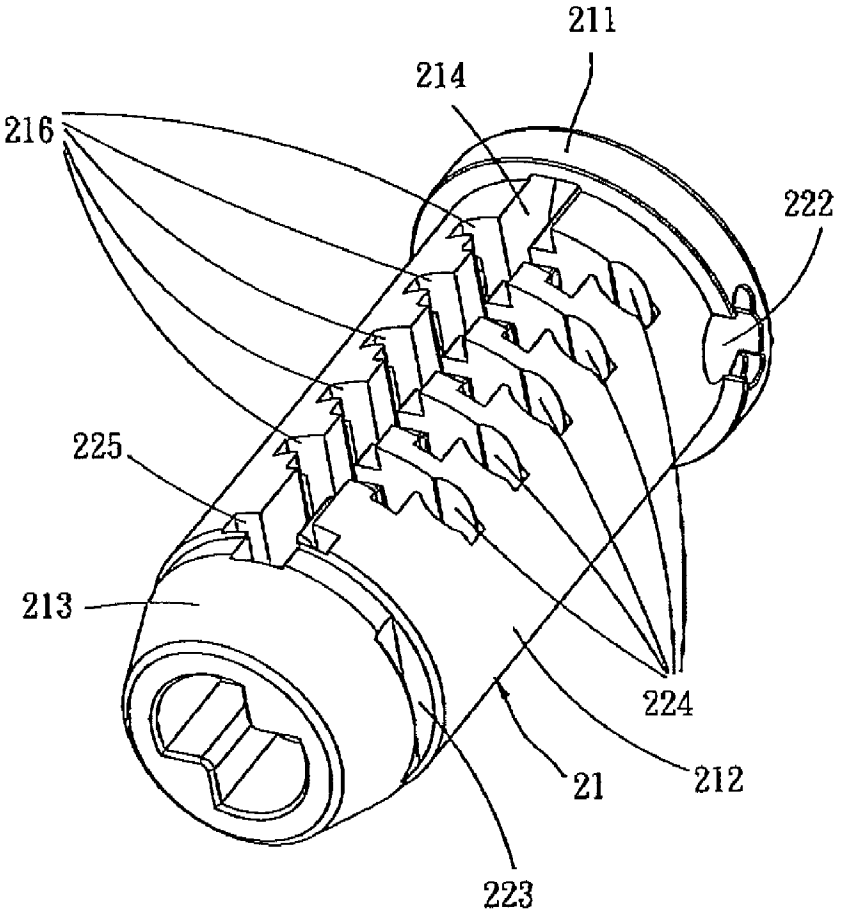
FIG. 5 is a perspective view of a plug of the re-keyable cylinder lock.
Figure 7:
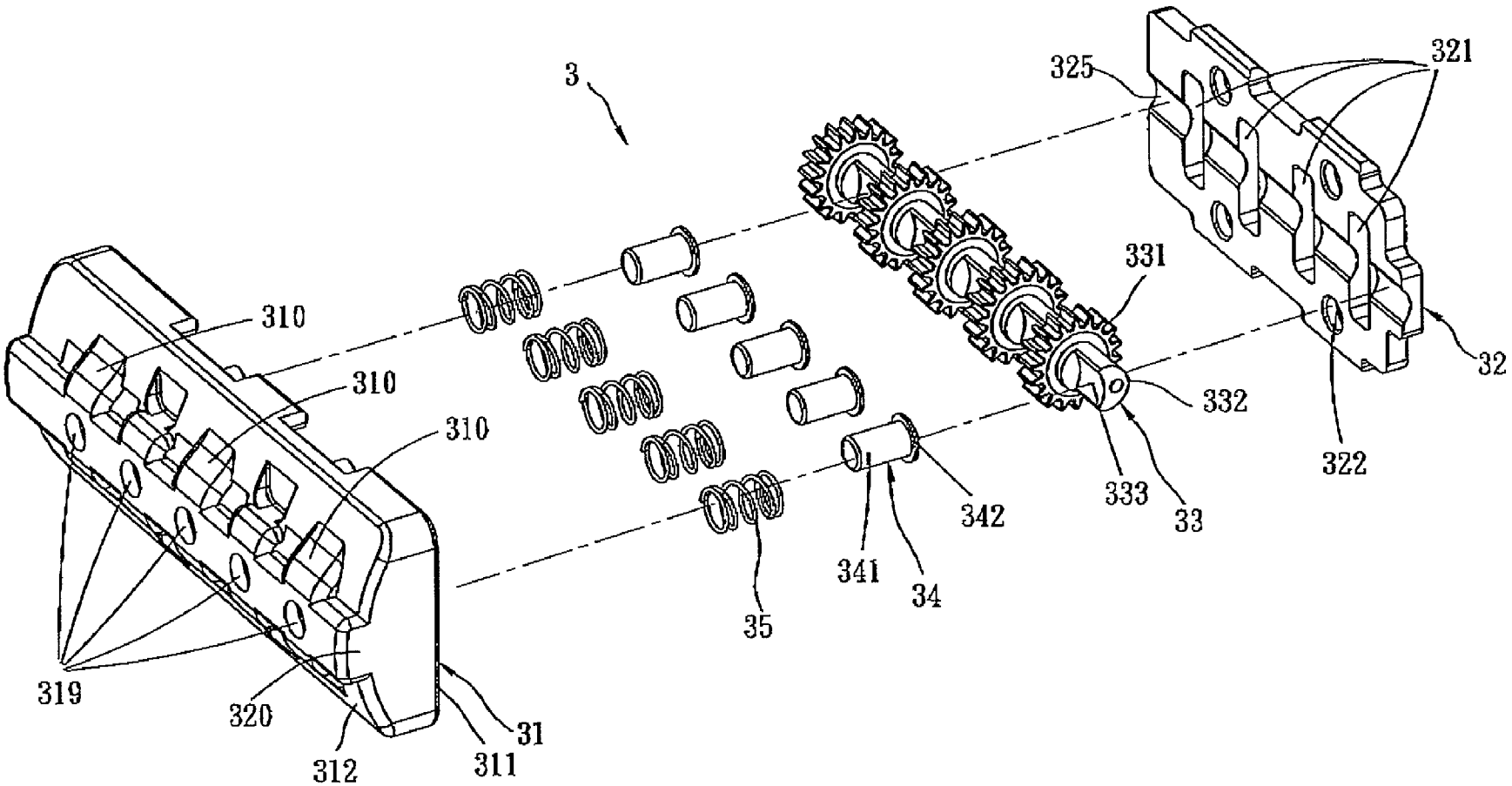
FIG. 7 is an exploded view of the re-keying unit.

Referring to FIG. 4 in combination with FIG. 2, the control member 41 is a substantially rectangular plate disposed within the cavity 119 to permit or restrict transverse movement of the re-keying unit 3. The control member 41 is movable axially and rearwardly of the lock housing 11, and includes a front end formed with a tongue 411 that extends into the spring space 117, and a concaved face 412. The spring 42 is disposed in the concaved face 412 and the spring space 117 to bias the tongue 411. The control member 41 further has four spaced apart guide noses 413 and five spaced detent slots 414 arranged in one row. Each guide nose 413 has two opposite slanting faces 416. The tongue 411 has a front face 415, Referring to FIG. 5 in combination with FIG. 2, the plug assembly 2 includes a plug 21, a plurality of first tumbler pieces 23, and a re-keying unit 3. The re-keying unit 3 is controlled by the control member 41.

The plug 21 includes a keyhole 214 (FIG. 1), a front plug section that has a front end flange 211, a middle plug section 212, and a rear plug section 213. The front plug section 211 has a pair of radial slots 222 (only one is shown) respectively receiving anti-drilling balls 25 biased by springs 27. The rear plug section 213 is connectable to a transmission rod (not shown), and has an annular groove 223 that receives a retaining ring 51. When the plug 21 is inserted into the plug hole 120 of the lock housing 11, it is retained rotatably within the plug hole 120 by the retaining ring 51.

The middle plug section 212 has a plurality of spaced apart spring holes 224 respectively receiving tumbler springs 24, a plurality of spaced apart tumbler holes 216 respectively receiving the first tumbler pieces 23, and a tumbler hole 225 disposed at one end of the key hole 214 and receiving a second tumbler piece 28 and a spring 24. Each spring hole 224 is communicated with one of the tumbler holes 216. The middle plug section 212 is substantially cylindrical and has one side thereof grooved to form a groove 228. The tumbler holes 216 are communicated with the groove 228. Separation springs 26 are disposed between the middle plug section 212 and the re-keying unit 3 and are mounted on respective spring retainers 217 (only one is shown in FIG. 2).

The first tumbler pieces 23 are flat pieces which are respectively received in the tumbler holes 216. Each first tumbler piece 23 has a spring-bearing part 231 to abut against the respective tumbler spring 24, a toothed part 232, a key-contacting part 233, and a projection 234.

The second tumbler piece 28 has a central aperture 281, a retaining pin 284 extending into the corresponding spring 24, and an engaging end 283 opposite to the spring 24.

Referring to FIGS. 6 to 9 in combination with FIG. 2, the re-keying unit 3 is disposed in the groove 228 of the plug 21 and is rotatable along with the plug 21. The re-keying unit 3 includes a gear holder 31, a cover plate 32, a plurality of gear wheels 33, and a plurality of detent elements 34 and detent springs 35. The gear holder 31 has an outer curve surface 312, and an inner flat side 311. A protrusion 320 projects from the outer curved surface 312. A plurality of stepped holes each having a small hole section 319 extending inwardly from the protrusion 320 and connected to a large hole section 317. A longitudinal slot 313 intersects five transverse slots 314 near the flat side 311. The gear holder 31 further has a receiving space 315, two slots 309, four pins 316 (only two are shown), and a quartered spherical recess 318. The protrusion 320 has a plurality inclined faces 310.

Each detent element 34 is formed as a headed rod and has a stem 341 which is sized and shaped in such a manner that the stem 341 can extend into the respective small hole section 319 in the gear holder 31 and the respective detent slot 414 formed in the control member 41, and a head 342 which is sized and shaped in such a manner that the head 342 can retain the respective detent spring 35. The stem 341 and the head 342 of each detent element 34 are respectively received in the small and large hole sections 319, 317 of each stepped hole. Each detent spring 35 is sleeved onto the stem 341 of the respective detent element 34.

Each gear wheel 33 has radial gear teeth 331 engaging releasably the toothed part 232 of the respective first tumbler piece 23, and an integral cam portion 332 connected coaxially to a central part of the gear wheel 33. Each gear wheel 33 is received in the respective transverse slot 314, and each cam portion 332 is received in the longitudinal slot 313. The gear wheels 33 are rotatable in response to movements of the first tumbler pieces 23 upon insertion of a key into the plug 21. Each cam portion 332 has an indented face 333 and is rotatable along with the respective gear wheel 33 to control the respective detent element 34 to engage or disengage from the respective detent slot 414. When the heads 342 of the detent elements 34 contact the respective indented faces 333 of the cam portions 33, the detent elements 34 disengage from the respective detent slots 414.

The cover plate 32 is received in the receiving space 315 and has a plurality of transverse holes 321, and four pin holes 322. The transverse holes 321 permit the teeth of the respective gear wheels 33 to extend therethrough for engagement with the respective first tumbler pieces 23 disposed in the plug 21. The pin holes 322 are provided for insertion of the respective pins 316. The cover plate 32 further has a longitudinal recess 325 receiving portions of the cam portions 332.

Referring back to FIGS. 2 to 9, the control member 41 is assembled in the cavity 119 with the front face 415 thereof being exposed from the first end 111 of the lock housing 11. The spring 42 is placed within the spring space 117 of the lock housing 11 and the concaved face 412 to bias the tongue 411 of the control member 41 so that the control member 41 is normally moved forward to a first position (FIGS. 8-12). The control member 41 is operable manually to move axially and rearwardly from the first position to a second position (not shown) and is movable transversely to a third position (FIG. 16) immediately after reaching the second position. In the second position, the guide noses 413 are at the outside of the respective guide holes 116 of the lock housing 11 but are aligned with the respective guide holes 116. In the third position, the guide noses 413 extend into the respective guide holes 116.

The protrusion 320 of the gear holder 31 is received in the plug hole 120 (see FIG. 9) when the control member 41 is in the first and second positions and projects into the cavity 119 from the plug hole 120 (see FIG. 17) when the control member 41 is in the third position.

The first tumbler pieces 23 and the tumbler springs 24 are respectively assembled in the tumbler holes 216 and the spring holes 224. The second tumbler piece 28 and the respective spring 24 are received in the tumbler hole 225. The spring-bearing part 231 of the first tumbler pieces 23 abut against the respective spring 24. The retaining pin 284 extends through the respective spring 24. The toothed parts 232 of the first tumbler pieces 23 are arranged to expose from the openings of the tumbler holes 216.

Figure 8:
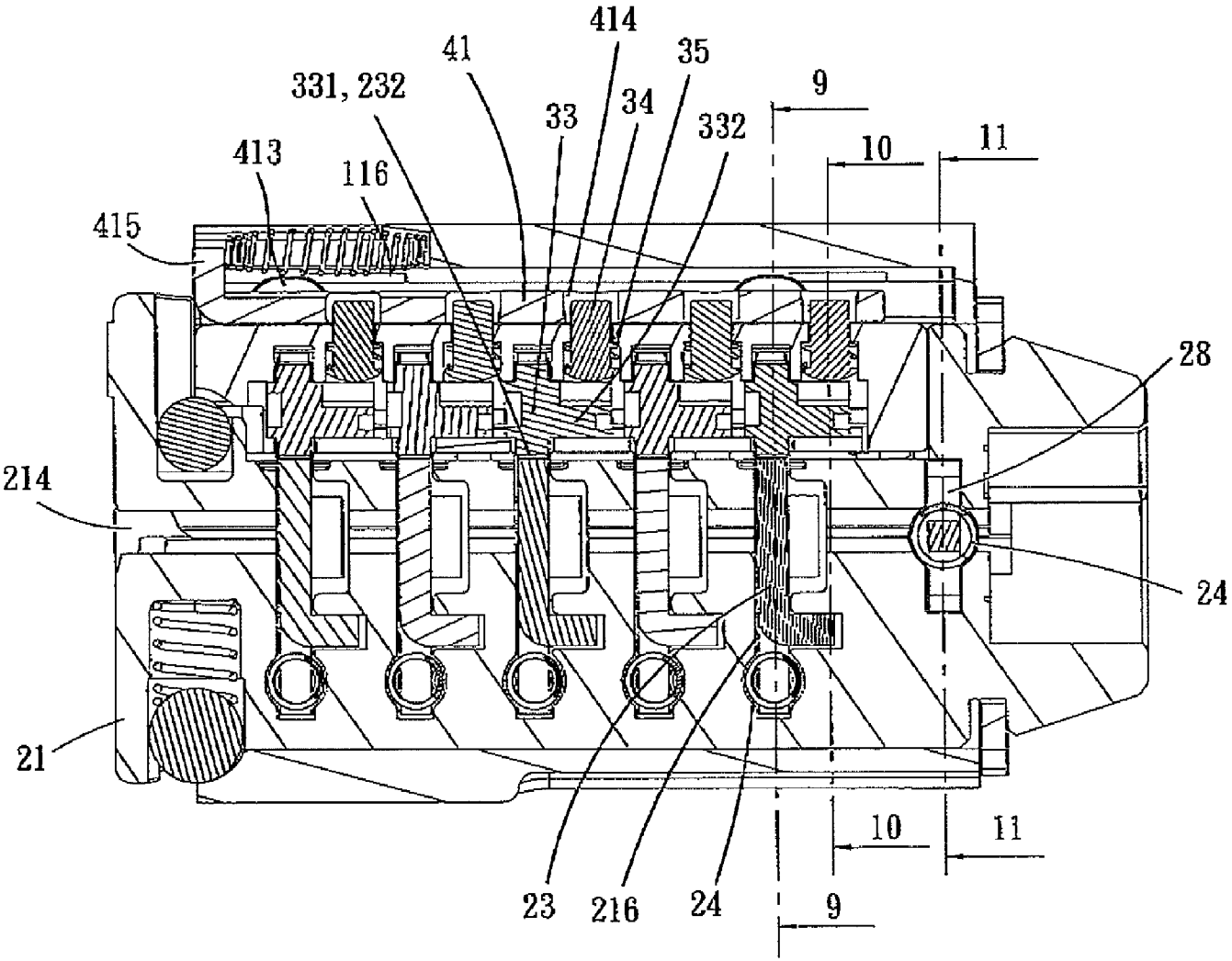
FIG. 8 is a longitudinal sectional view of the re-keyable cylinder lock.
Figure 10:
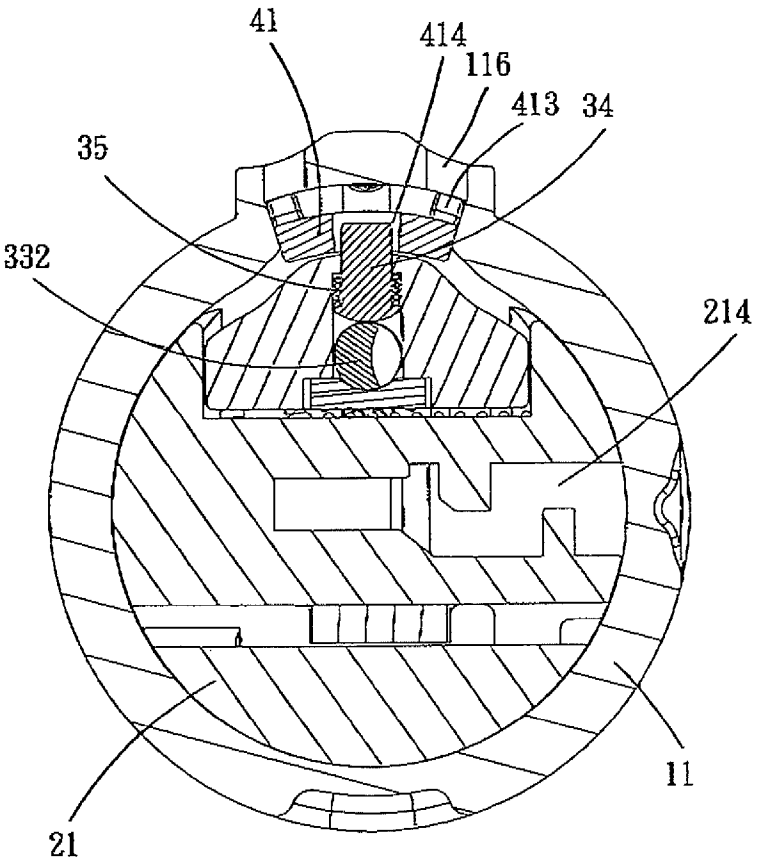
FIG. 10 is another transverse sectional view taken along line 10-10 of FIG. 8.
Figure 9:
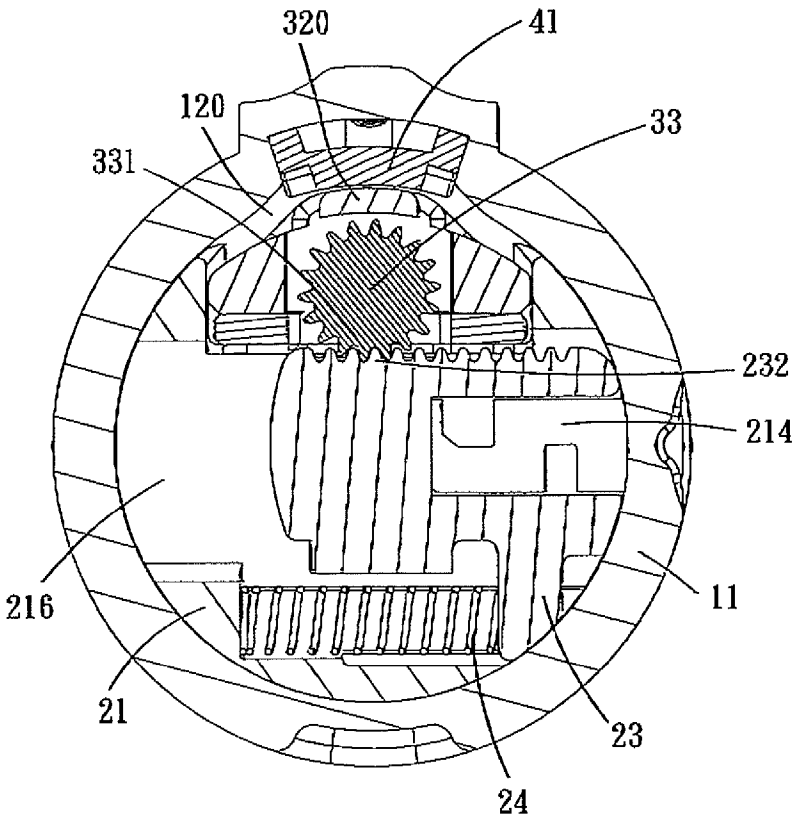
FIG. 9 is a transverse sectional view taken along line 9-9 of FIG. 8.
Figure 11:
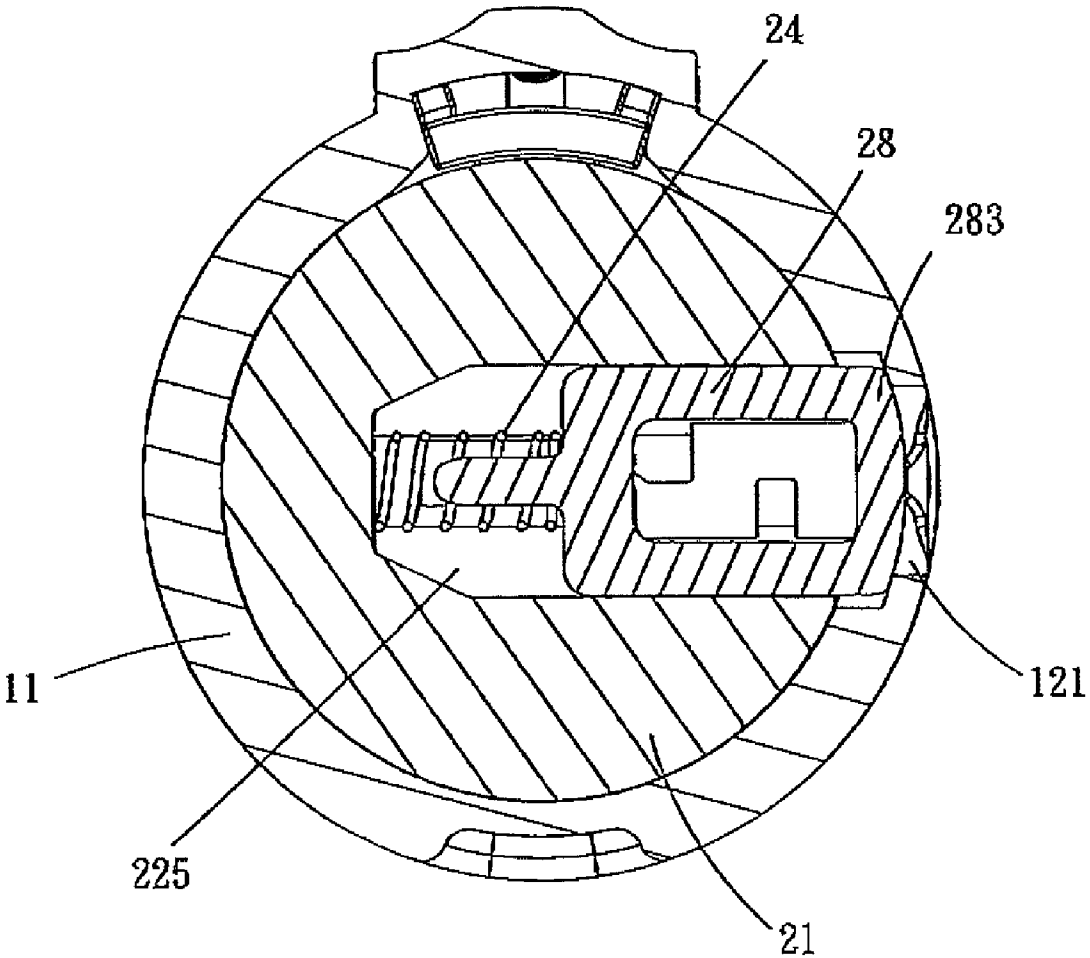
FIG. 11 is still another transverse sectional view taken along line 11-11 of FIG. 8.
Figure 12:
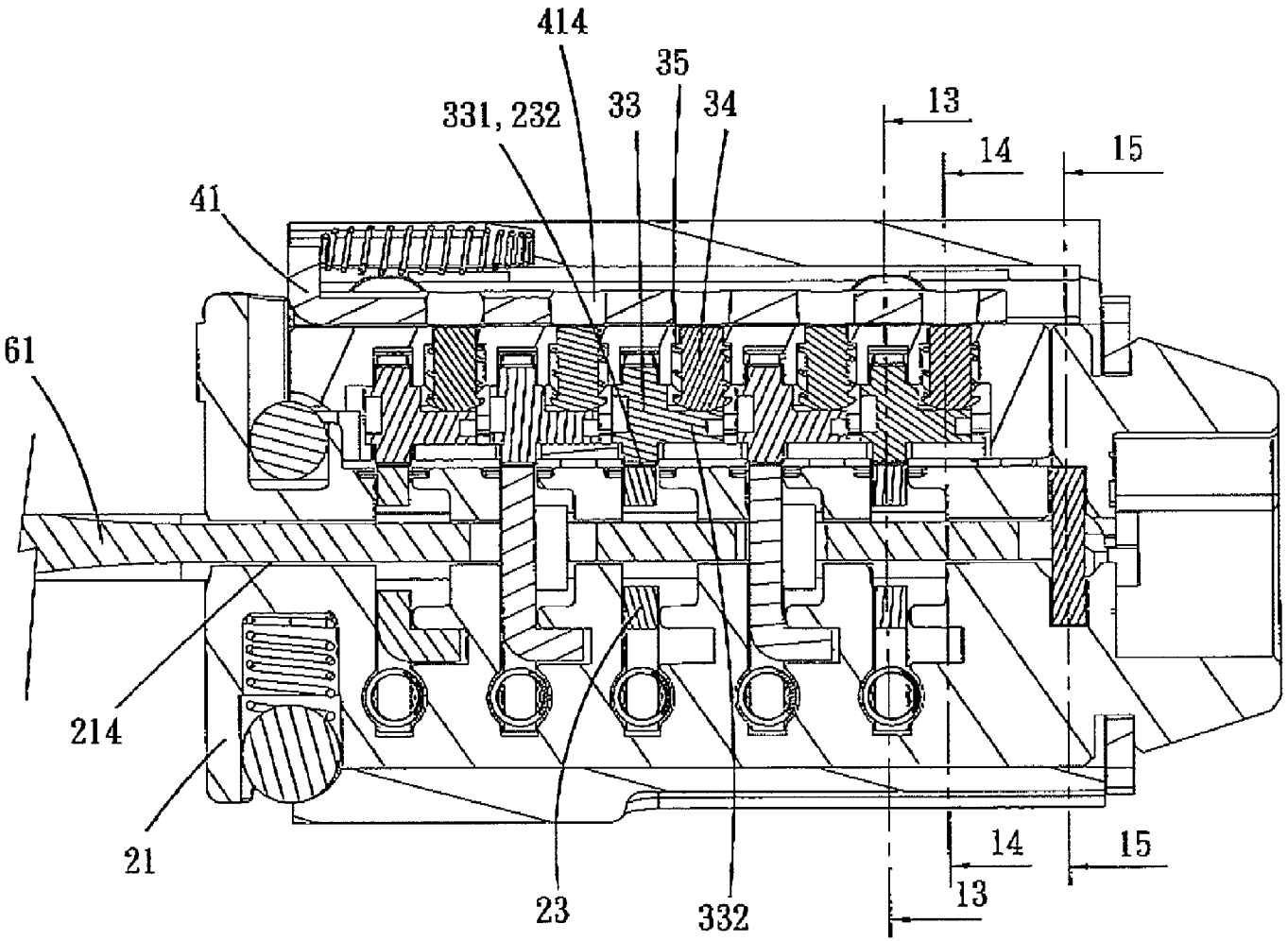
FIG. 12 is the same view as FIG. 8 but showing a first key inserted into the plug.
Figure 14:
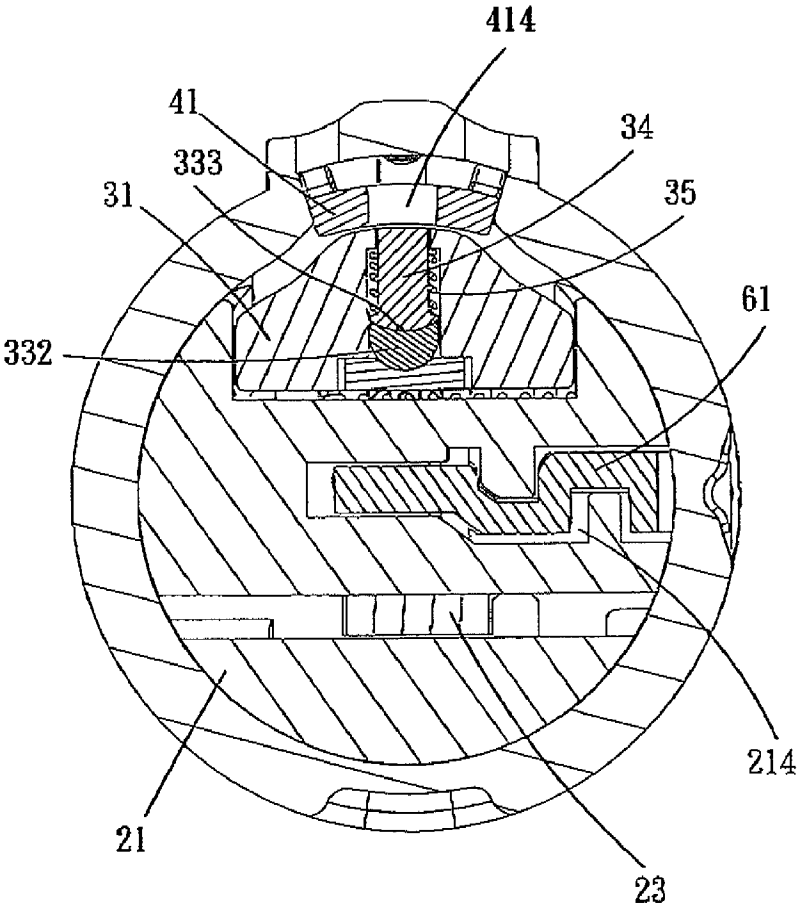
FIG. 14 is another transverse sectional view taken along line 14-14 of FIG. 12.
Figure 13:
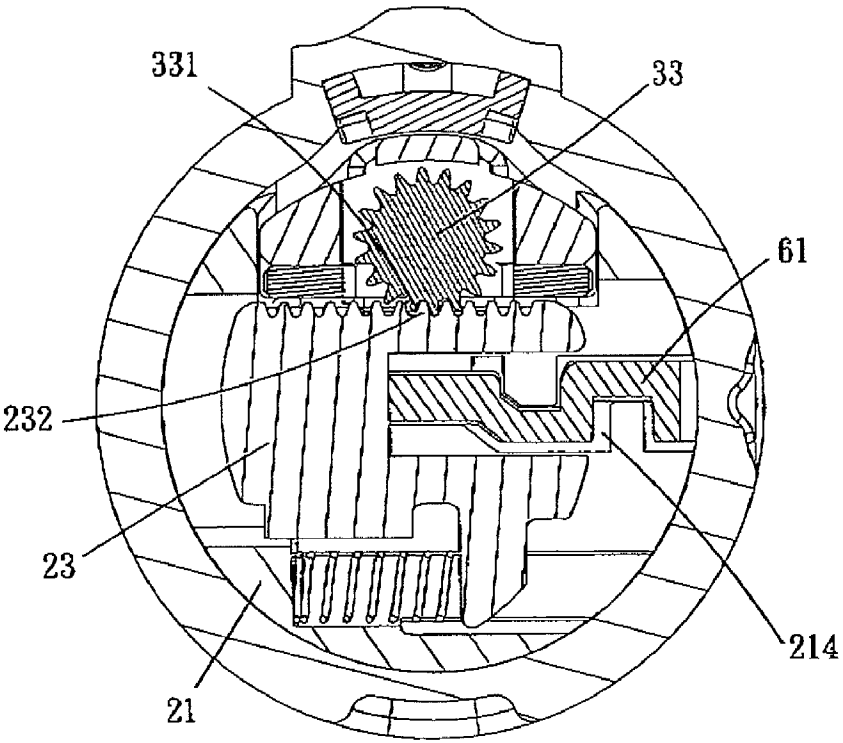
FIG. 13 is a transverse sectional view taken along line 13-13 of FIG. 12.
Figure 15:
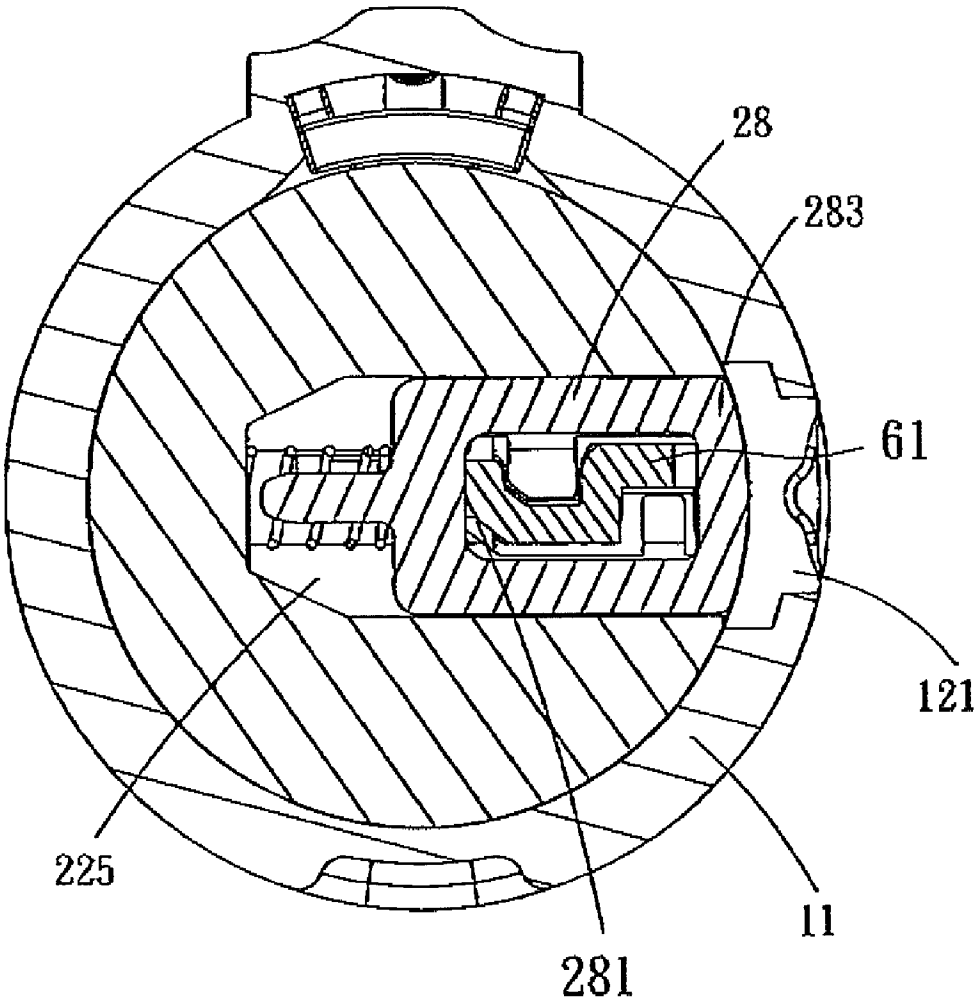
FIG. 15 is still another transverse sectional view taken along line 15-15 of FIG. 12.

Referring to FIGS. 10-11 in combination with FIGS. 8-9, when no key is inserted into the plug 21, the tumbler pieces 23 are moved to bottom ends of the respective tumbler holes 216 by the action of the tumbler springs 24, and the gear wheels 33, which are engaged with the respective first tumbler pieces 23, are in a position in which the cam portions 332 cam the respective detent elements 34 to project into the respective detent slots 414 through the stepped holes in the gear holder 31. The engaging end 283 of the second tumbler piece 28 is biased by the respective spring 24 to extend into a stepped retaining hole 121 (FIG. 11) in the lock housing 11. Therefore, the plug assembly 2 is limited from rotation relative to the lock housing 11.

Referring to FIGS. 12-15, when a first key 61 is inserted into the key hole 214 without rotating the plug 21, the first key 61 moves the first tumbler pieces 23 against the tumbler springs 24 so that the toothed parts 232 thereof rotate the respective gear wheels 33 and the cam portions 332. The first key 61 also extends into the central aperture 281 of the second tumbler piece 28 and moves the second tumbler piece 28 away from the stepped retaining hole 121 of the lock housing 11. At this state, the indented faces 333 of the cam portions 332 contact the respective detent elements 34 so that the detent elements 34 move away from the respective detent slots 414 by the action of the detent springs 35. That is to say, the detent elements 34 retract from the detent slots 414.

Figure 16:
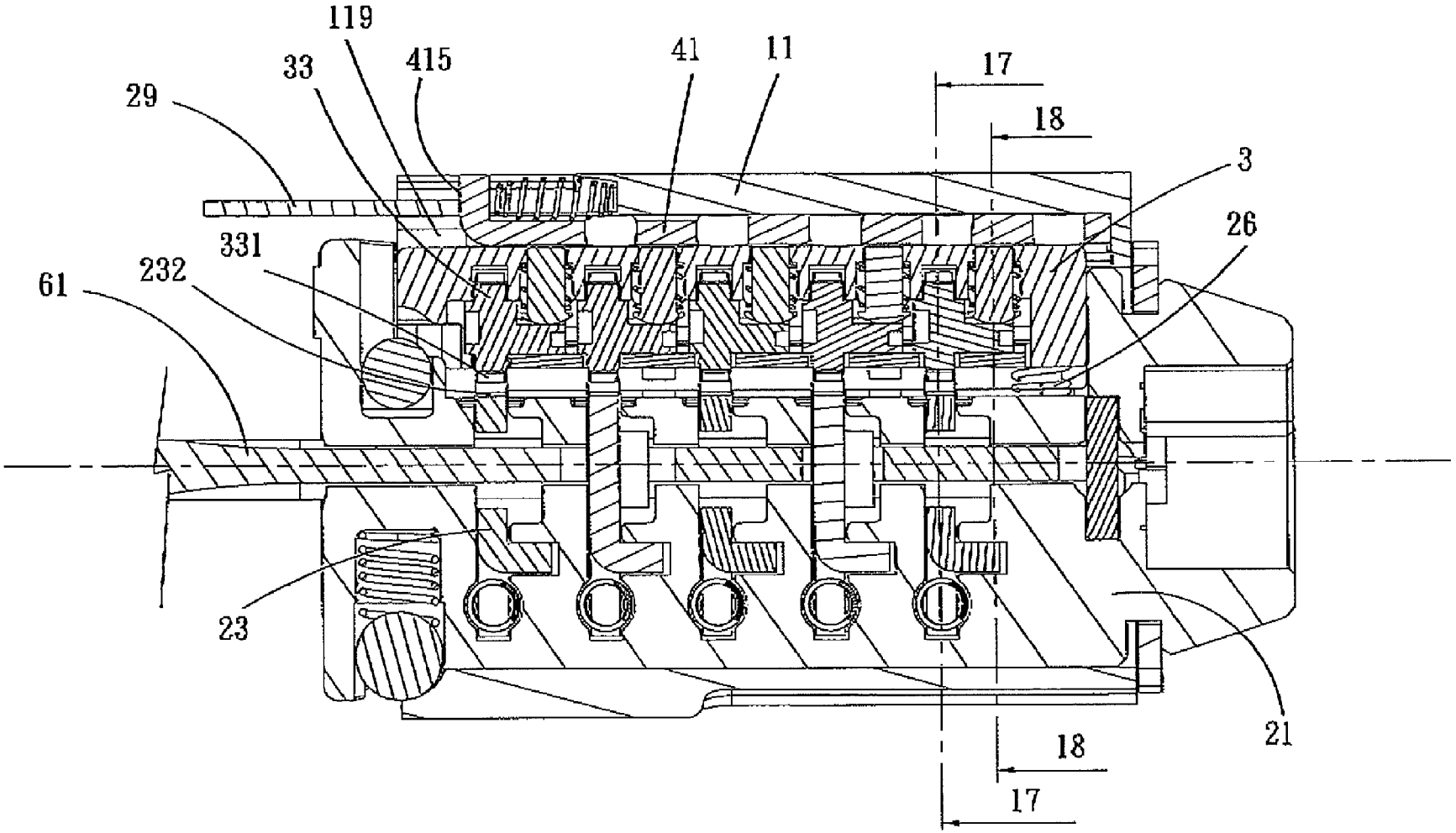
FIG. 16 is the same view as FIG. 12 but showing that gear wheels disengage from respective first tumbler pieces.
Figure 18:
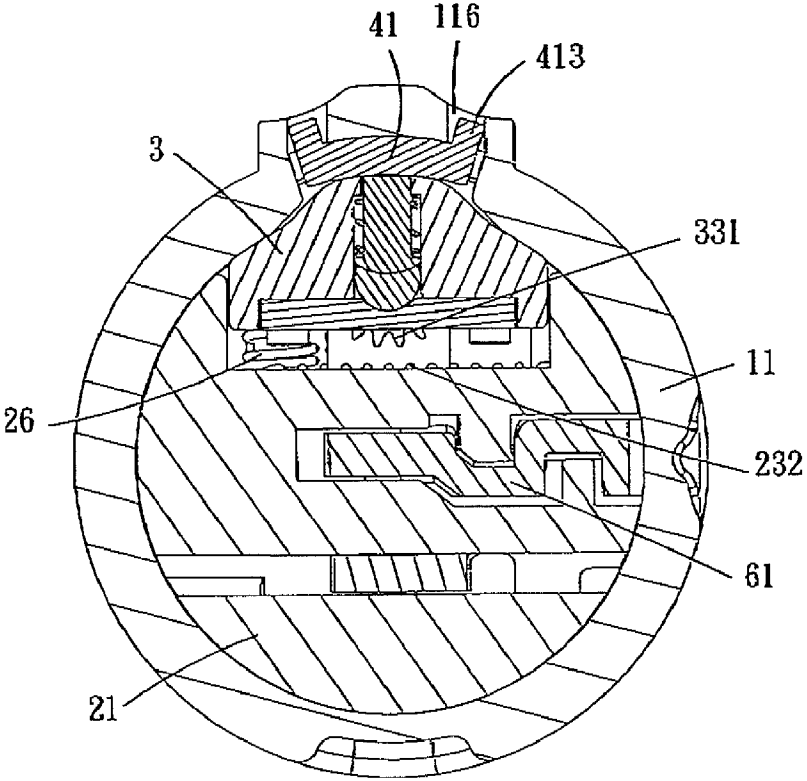
FIG. 18 is another transverse sectional view taken along line 18-18 of FIG. 16.
Figure 17:
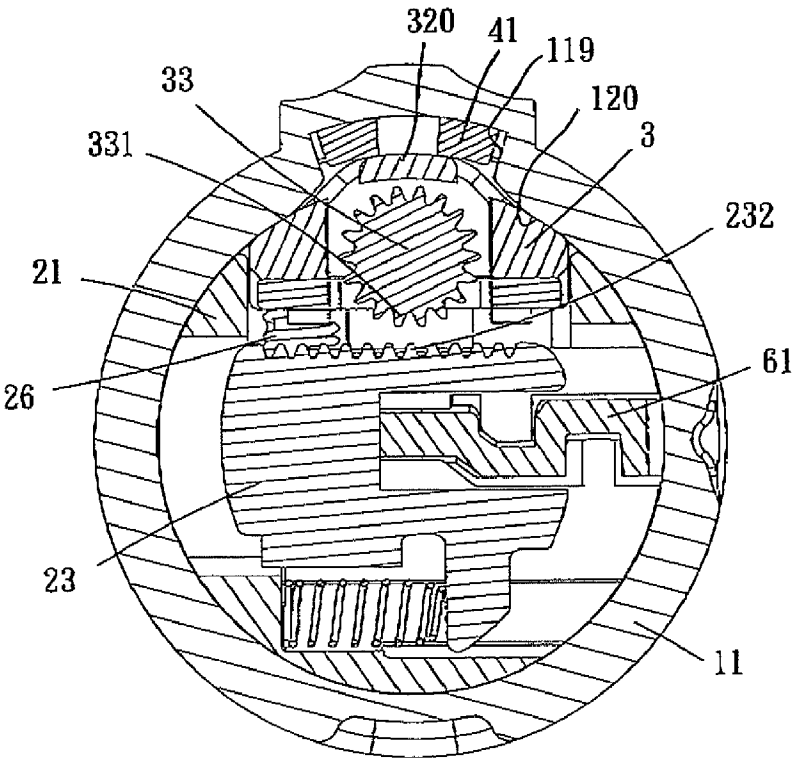
FIG. 17 is a transverse sectional view taken along line 17-17 of FIG. 16.
Figure 19:
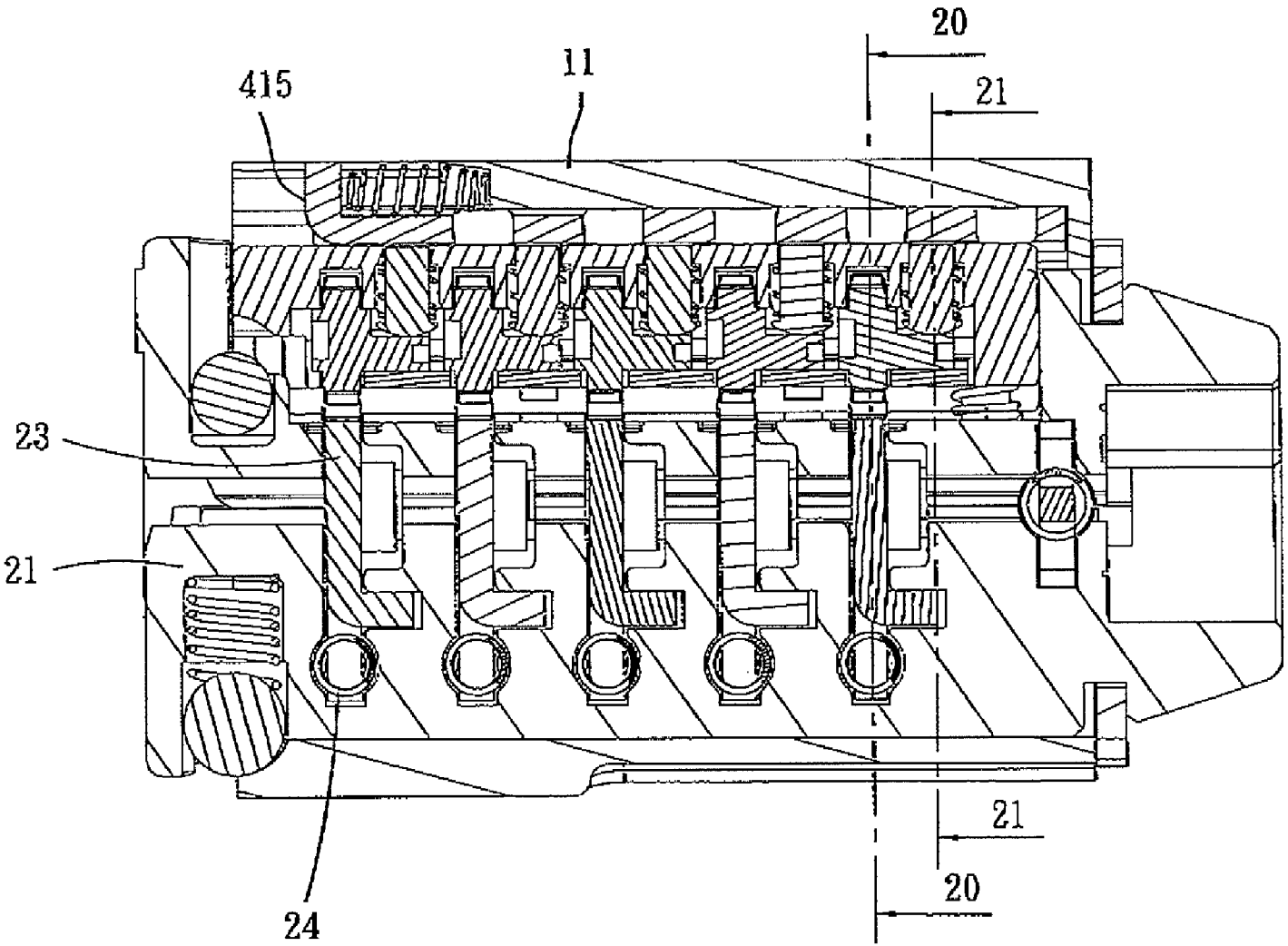
FIG. 19 is the same view as FIG. 16 but showing that the first key is removed from the plug.
Figure 21:
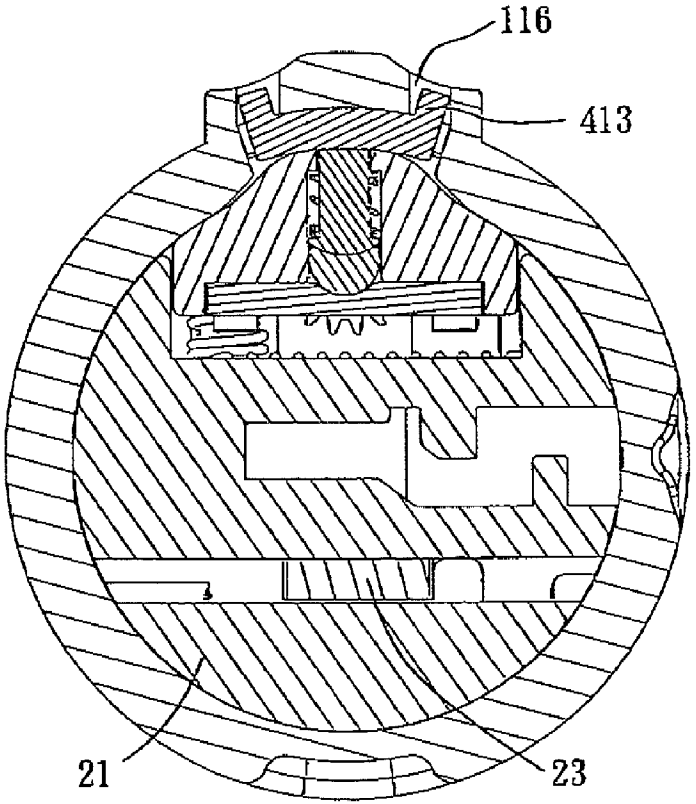
FIG. 21 is another transverse sectional view taken along line 21-21 of FIG. 19.
Figure 20:
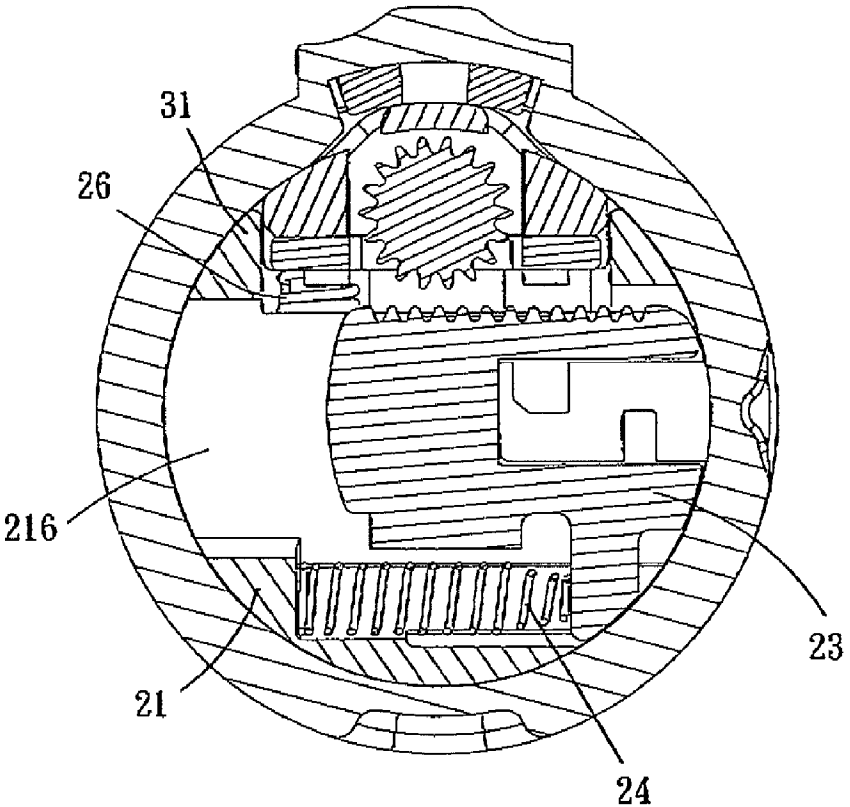
FIG. 20 is a transverse sectional view taken along line 20-20 of FIG. 19.

Referring to FIGS. 16-18 when a tool 29 is inserted into the cavity 119 while the first key 61 is still in the plug 21 which is in its home position, the tool 29 pushes the front face 415 of the control member 41 so that the control member 41 is moved from the first position where the guide noses 413 of the control member 41 are not aligned with the respective guide holes 116 of the lock housing 11 (FIGS. 8, 10) to a second position where the guide noses 413 are aligned with the respective guide holes 116. At this state, the guide noses 413 immediately move transversely and extend into the respective guide holes 116, thereby reaching the third position (FIG. 18). The gear holder 31 is thus permitted to move transversely via the action of the separation springs 26. As a result, the gear wheels 33 disengage from the respective toothed parts 232 of the first tumbler pieces 23, thereby permitting the re-keying of the first tumbler pieces 23. Referring to FIGS. 19-21 in combination with FIG. 11, the tool 29 is removed from the lock housing 11, and the first key 61 is removed from the plug 2 for re-keying the first tumbler pieces 23 with a second key 62 (FIG. 22) which has a different profile from the first key 61. As the first key 61 is removed, the first and second tumbler pieces 23, 28 return to their original positions, and the plug 21 is prevented from rotation. At this state, although the tool 29 is removed, the control member 41 is not moved back to the first position, because the guide noses 413 are pushed into the respective guide holes 116 by the gear holder 31 which is biased by the springs 26.

Figure 22:
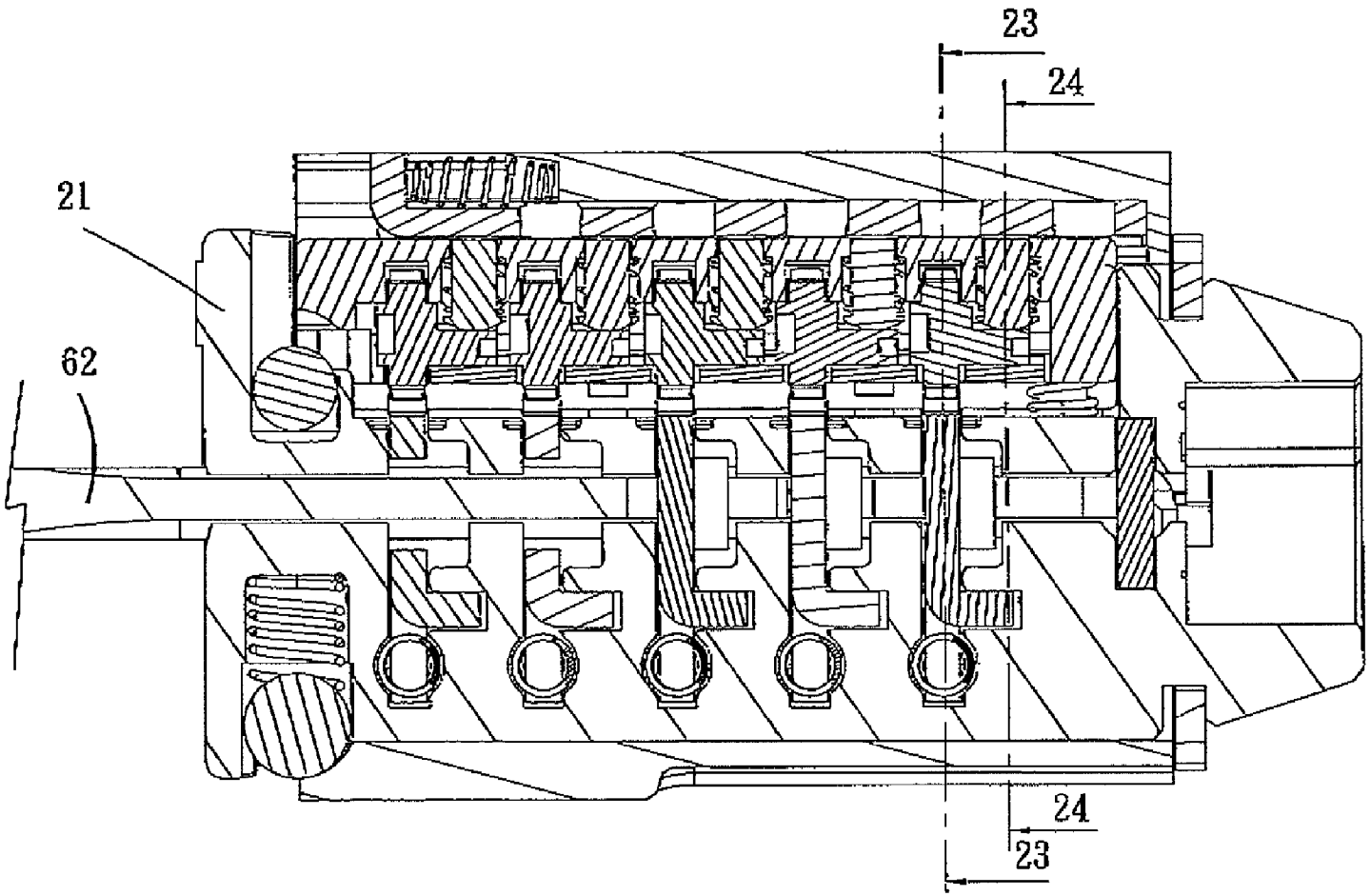
FIG. 22 is the same view as FIG. 19 but showing that a second key is inserted.
Figure 24:
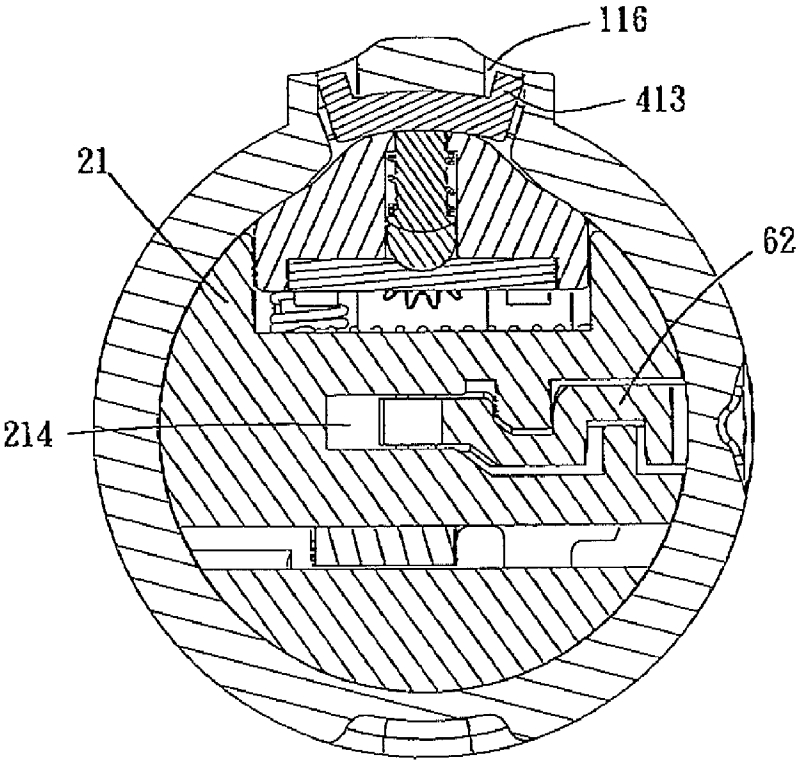
FIG. 24 is another transverse sectional view taken along line 24-24 of FIG. 22.
Figure 23:
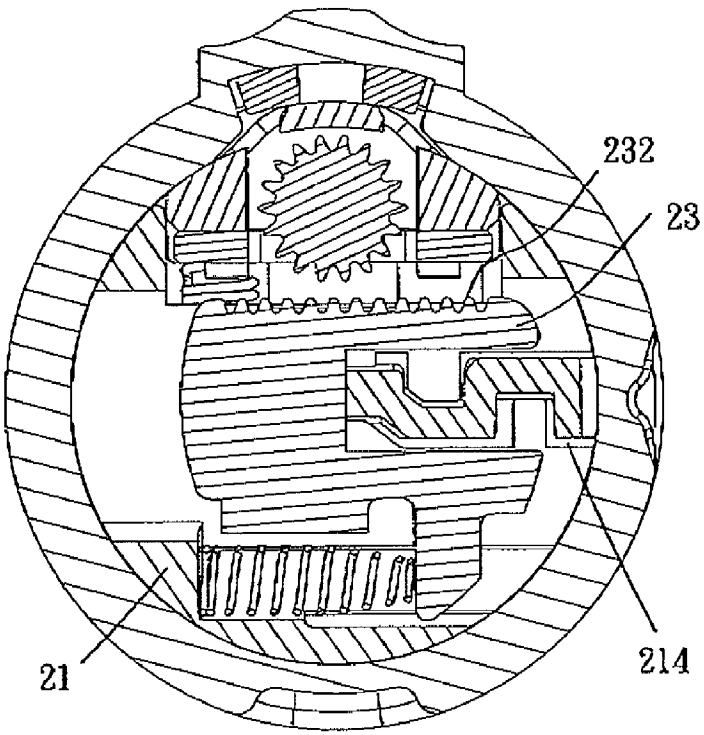
FIG. 23 is a transverse sectional view taken along line 23-23 of FIG. 22.
Figure 26:
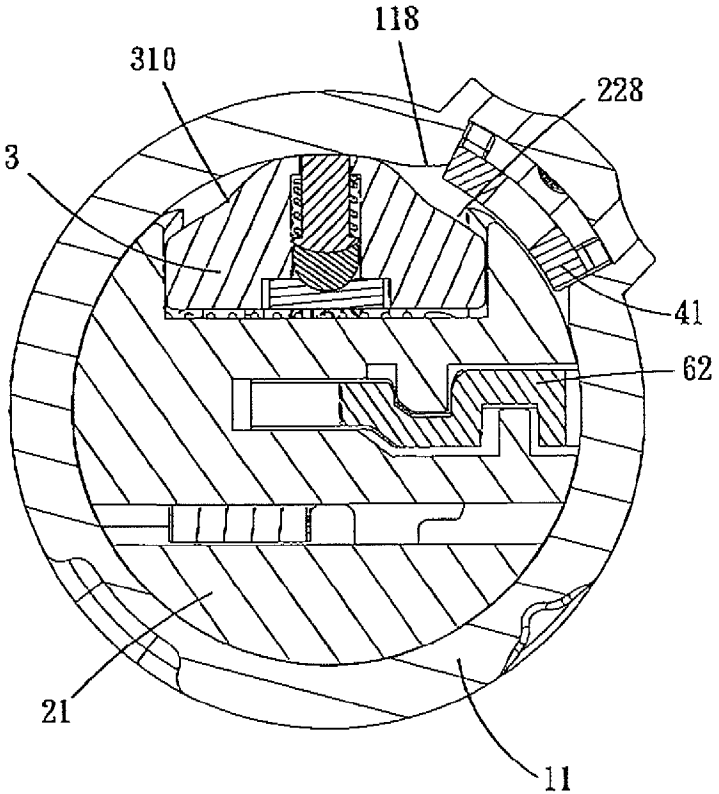
FIG. 26 is the same view as FIG. 24 but showing that the gear wheels re-engage the respective first tumbler pieces.
Figure 25:
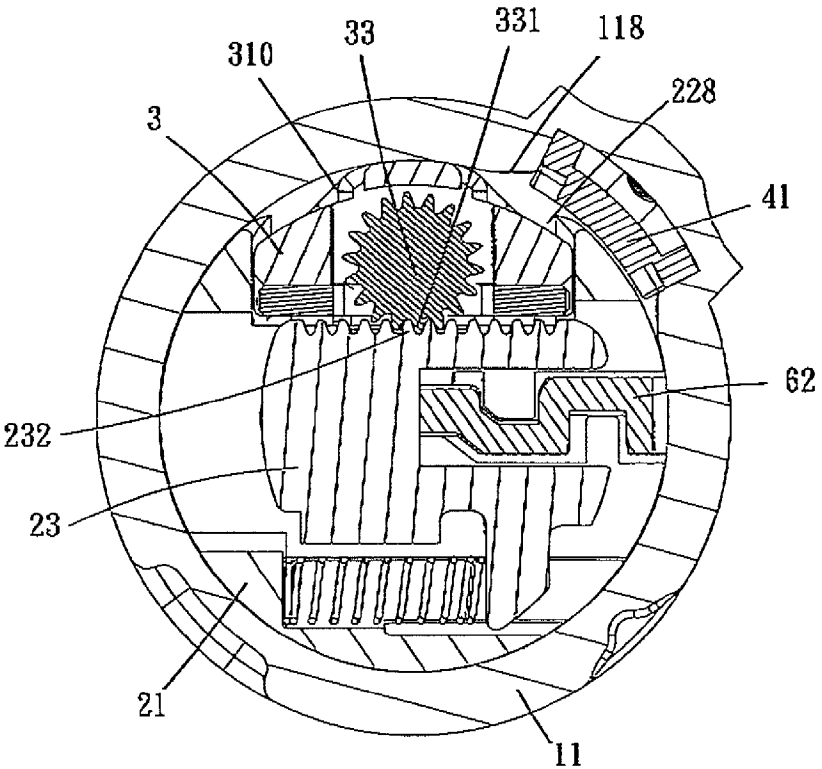
FIG. 25 is the same view as FIG. 23 but showing that the gear wheels re-engage the respective first tumbler pieces.

Referring to FIGS. 22-24, when the second key 62 is inserted, the toothed parts 232 of the first tumbler pieces 23 are re-oriented according to the different profile of the second key 62. When the second key 62 is rotated by a predetermined angle, as shown in FIGS. 25 and 26, the plug 21 is rotated together with the gear holder 31 to move away from the home position. Therefore, the inclined faces 310 of the protrusion 320 of the gear holder 31 are pressed gradually by the slanting face 118 of the lock housing 11 so that the gear holder 31 retracts into the groove 228 of the plug 21, thereby re-engaging and repositioning the toothed parts 232 of the first tumbler pieces 23. As the control member 41 is no longer pushed by the gear holder 3S, it is permitted to return to the first position by the action of the biasing spring 42 (FIG. 2). This is because the biasing spring 42 causes the guide noses 413 to move out of the respective guide holes 116 by making the slanting faces 416 (FIG. 2) of the guide noses 413 to slide gradually over the edges of the respective guide holes 116 in the lock housing 11. Thereafter, the second key 62 can be rotated back to return the plug 21 to its home position.

Figure 27:
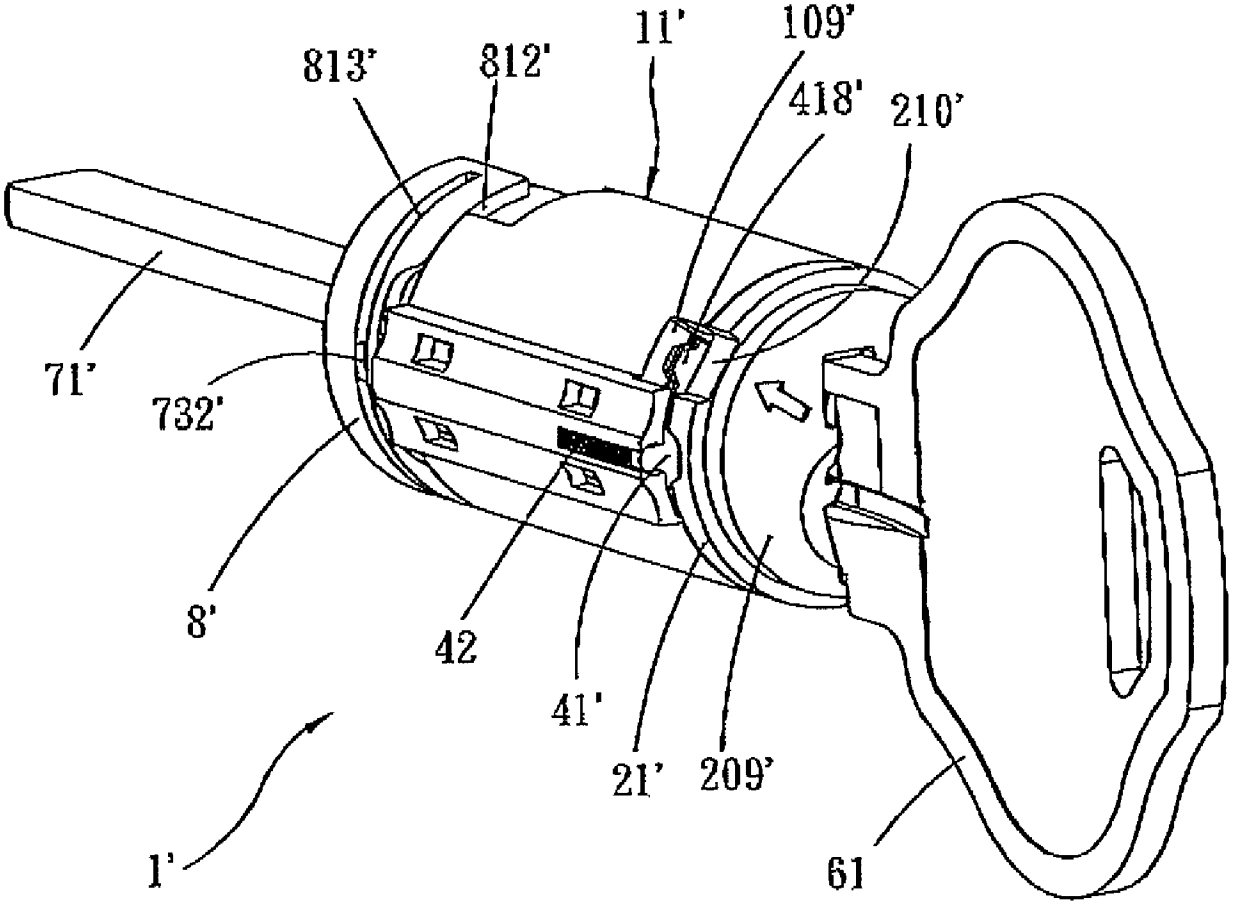
FIG. 27 is a perspective view of a re-keyable cylinder lock according to a second preferred embodiment of the present invention.
Figure 28:
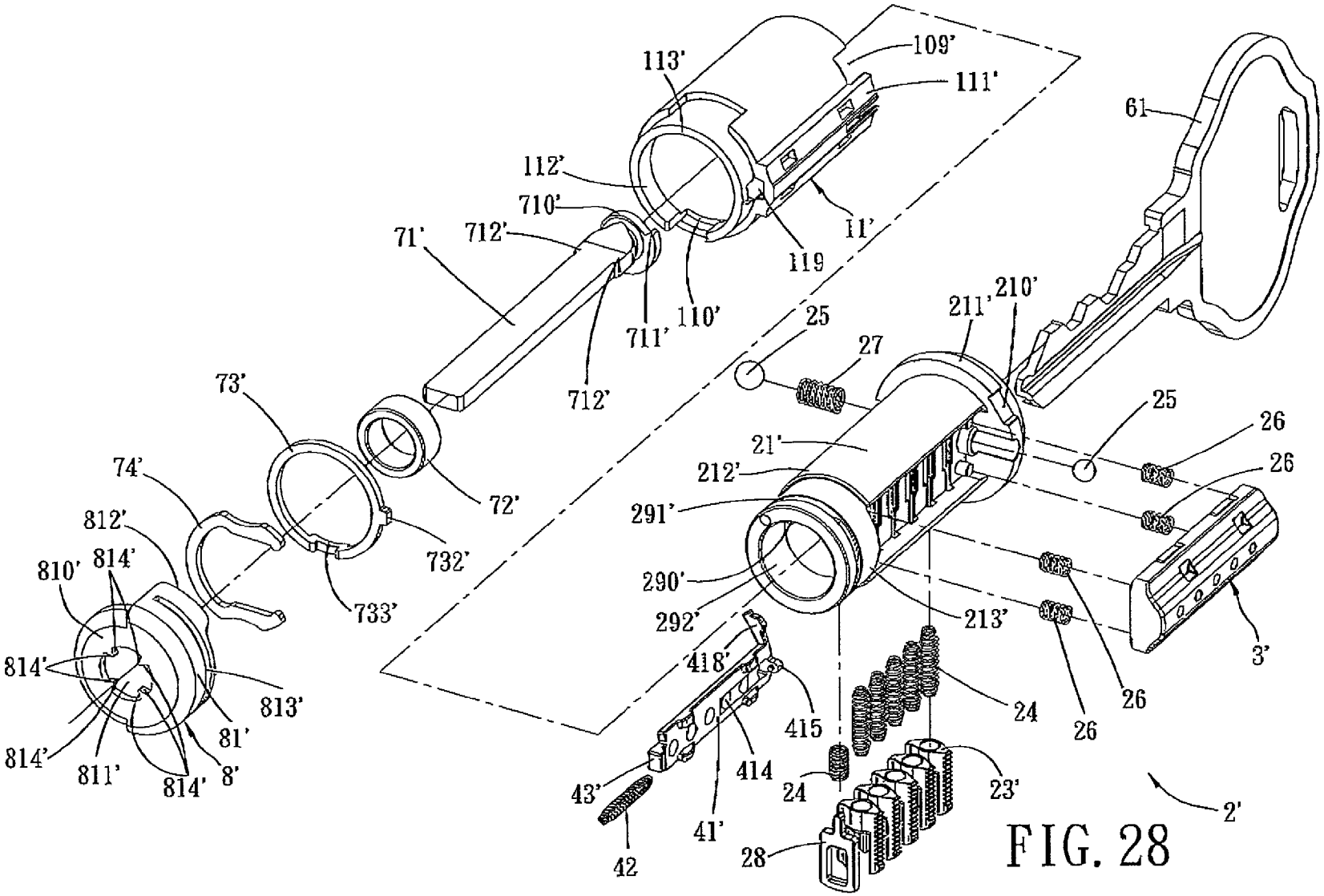
FIG. 28 is an exploded view of the re-keyable cylinder lock of FIG. 27.

Referring to FIGS. 27 and 28, there is shown a cylinder lock 1' according to a second preferred embodiment of the present invention which includes a lock housing 11', a plug assembly 2', a control member 41', a transmission rod 71', and an end cap 8'.

The lock housing 11' is substantially similar to the lock housing 11 of the first embodiment. However, the cylindrical wall 113' has a front notch 109' at a front end 111' and a rear notch 110' at a rear end 112'.

The plug assembly 2' is substantially similar to the plug assembly 2 of the first embodiment. However, the first tumbler pieces 23' are different in shape from the first tumbler pieces 23. The front end flange 211' of the plug 21' is provided with a front notch 210' and a front bump 209. The rear plug section 213' of the plug 21' has an outer surface formed with an annular plug groove 291', and a first transmission part 290' (FIGS. 28, 31) formed inside a rear bore 292'.

The re-keying unit 3' and the control member 41' are substantially similar to the re-keying unit 3 and the control member 41 in the first embodiment. However, the control member 41' has a security arm 418' that projects transversely and circumferentially from a front end of the control member 41' near the front end 111' of the lock housing 11' and that is operable manually through the front end 111' of the lock housing 11' to move the control member 41'. A rear end of the control member 41' is formed with a atop face 43'. The security arm 418' of the control member 41' extends into the front notch 109' of the lock housing 11' and is movable rearwardly within the front notch 109'. The front notch 210' in the front end flange 211' of the plug 21' can be aligned with the security arm 418' when the plug 21' is in a locking position. The security arm 418' is breakable to separate from the front end of the control member 41' when pushed by a tool with an excessive force. The detent slots 414 of the control member 41' may be nearly circular or elliptical.

The transmission plate 71' has an enlarged end plate 710' formed with a first driven part 711', and second transmission parts 712'. The end plate 710' and the second transmission parts 712' are inserted into the rear bore 292' so that the first driven part 711' engages the first transmission part 290' of the plug 21' and can be driven thereby. A blocking ring 72' is fitted in the rear bore 292' to press the end plate 710' against the plug 21', thereby preventing the transmission plate 71' from being released from the plug 21'.

The end cap 8' includes a surrounding wall 81' disposed rotatably around the rear plug section 213' and an end wall 810' connected to a rear end of the surrounding wall 81'. A front portion of the surrounding wall 81' extends around a rear portion of the lock housing 11' (see FIG. 31). A locking ring 74' is disposed between the surrounding wall 81' and the rear plug section 213'. The end wall 810' has an opening 811', and a plurality of second driven parts 814' projecting into the opening 811'. The surrounding wall 81' has two forwardly projecting limit members 812', an arc-shaped slot 813' extending through the surrounding wall 81', and an annular cap groove 815' (FIGS. 31, 34) formed in an inner surface of the surrounding wall 81'. The annular cap groove 815' is aligned with the annular plug groove 291' to define an annular space that receives the locking ring 74', thereby preventing the end cap 8' from being released from the rear plug section 213'.

The transmission rod 71' is inserted into the rear bore 292' through the opening 811' of the end cap 8' so that the second transmission parts 712' can engage and drive the second driven parts 814'.

Figure 29:
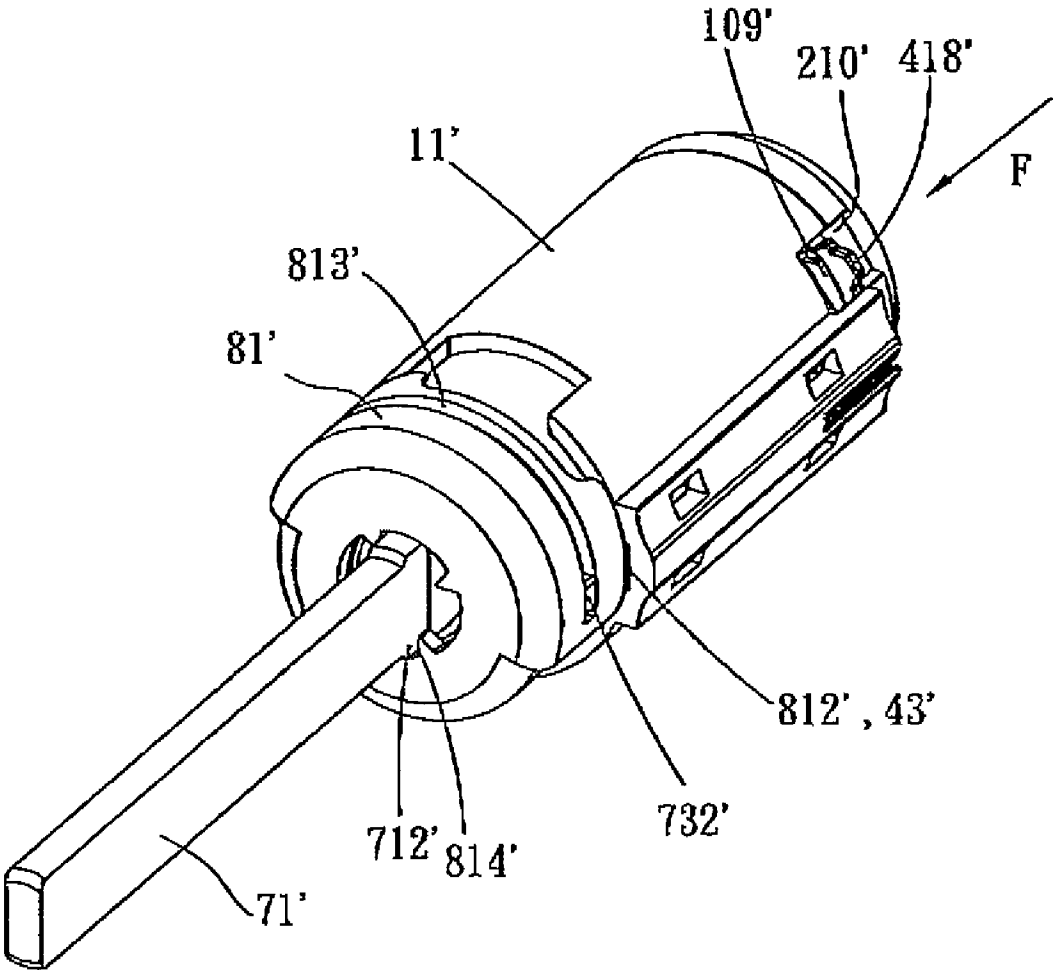
FIG. 29 is another perspective view of the re-keyable cylinder lock of FIG. 27.
Figure 30:
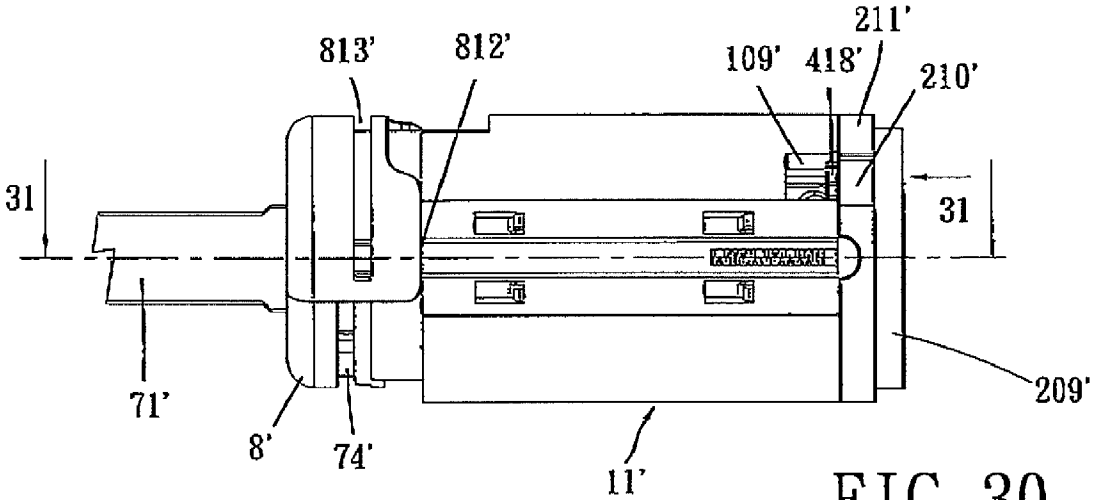
FIG. 30 is an elevation view of the re-keyable cylinder lock of FIG. 27.
Figure 31:
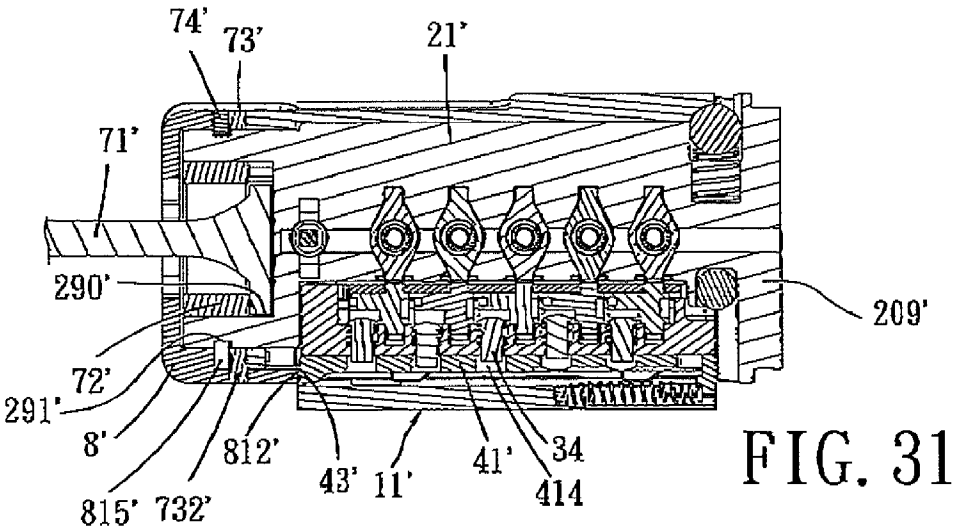
FIG. 31 is a sectional view of the re-keyable cylinder lock of FIG. 27.

The fixing ring 73' is sleeved non-rotatably around the rear plug section 213' within the surrounding wall 81' behind the lock housing 11', and abuts against the rear end of the lock housing 11'. The fixing ring 73' has a guide piece 732', and an ear 733' projecting therefrom. The ear 733' is engaged in the rear notch 110' in the lock housing 11', thereby limiting the fixing ring 73' from rotation. The guide piece 732' projects into the arc-shaped slot 813' from the fixing ring 73'. When the ear 733' is engaged in the rear notch 110', the guide piece 732' is aligned with the stop face 43' at the rear end of the control member 41'. Referring to FIGS. 29 to 31, the plug 21' is in a locking position, and no key is inserted into the plug 21'. The detent elements 34' extend into the respective detent slots 414. The limit member 812' is n a limiting position aligned with the stop face 43' of the control member 41', thereby limiting the control member 41' from moving rearward. In this position, if an excessive pushing force is applied through the front notch 210' of the plug 2' to the control member 41' as shown by arrow (F) in FIG. 29, the security arm 418' can break so that no external force can reach the control member 41' for destroying the same.

Figure 32:
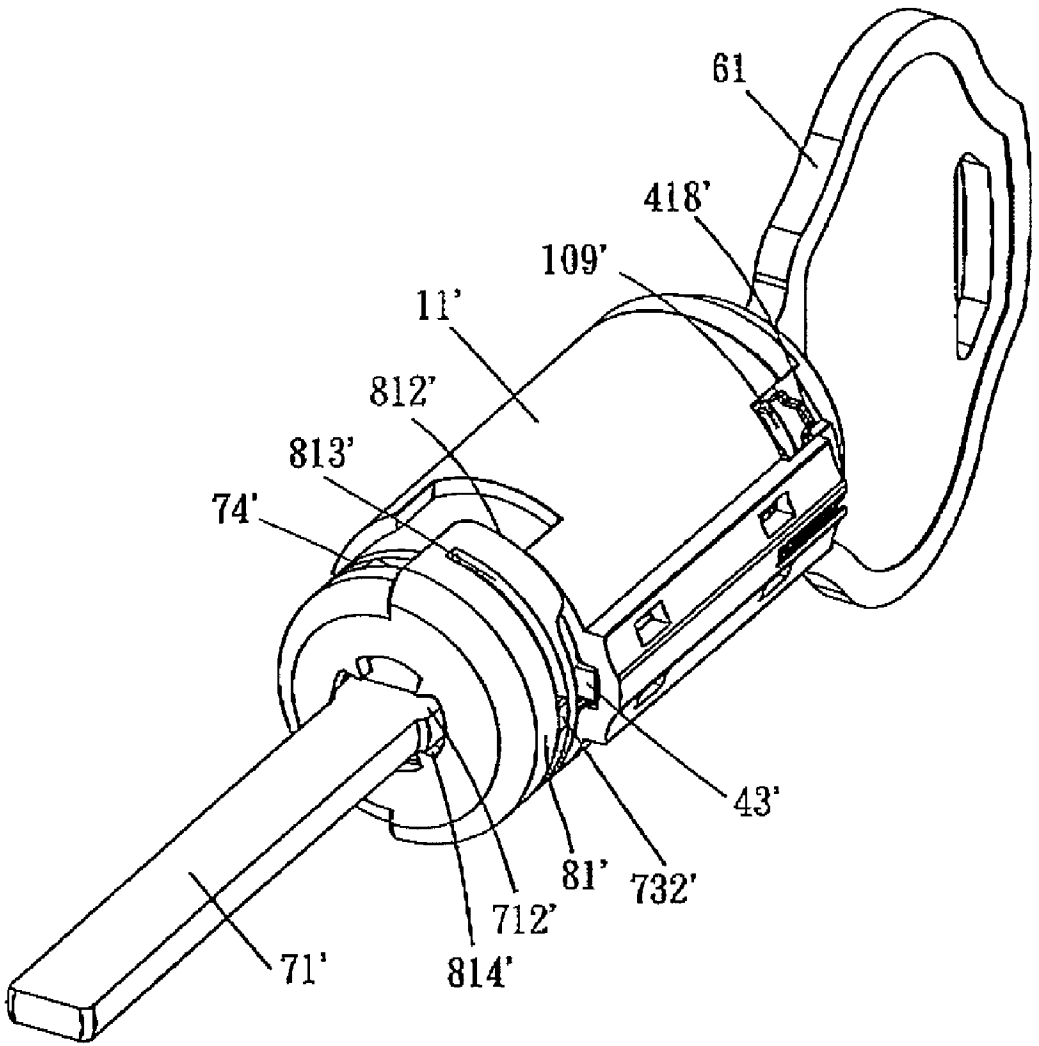
FIG. 32 is the same view as FIG. 29 but showing that a limit member is not aligned with a rear end of a control member.
Figure 33:
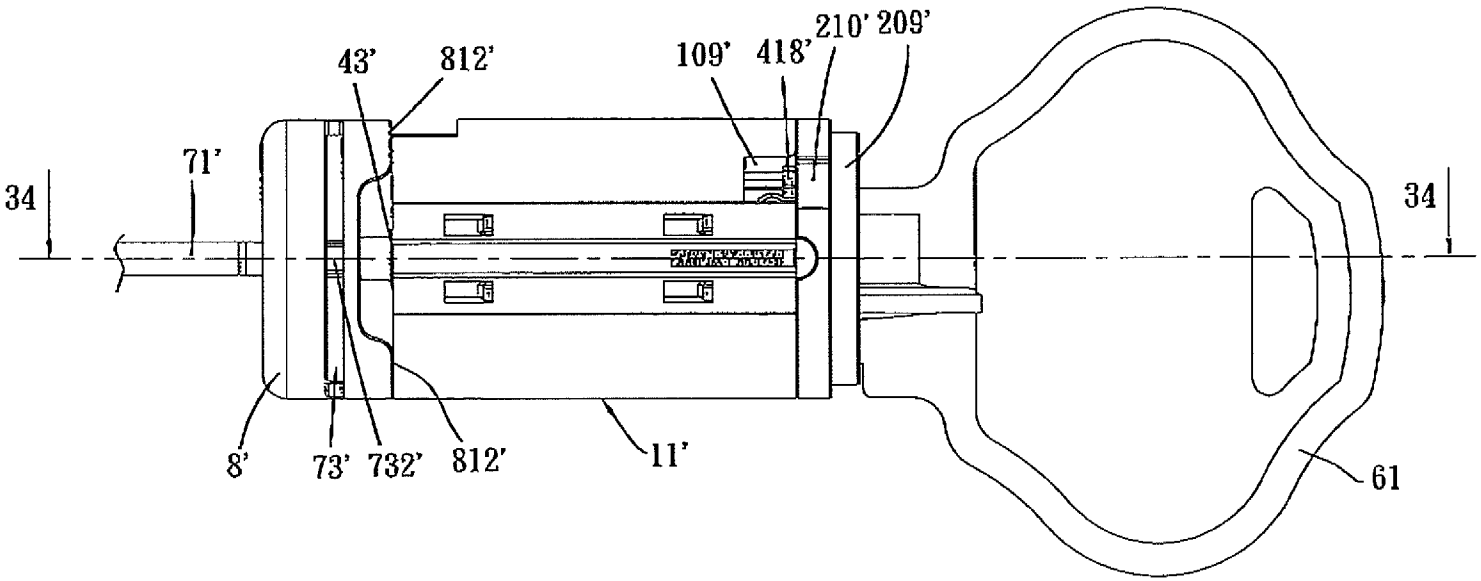
FIG. 33 is the same view as FIG. 30 but showing that the limit member is not aligned with the rear end of the control member.
Figure 34:
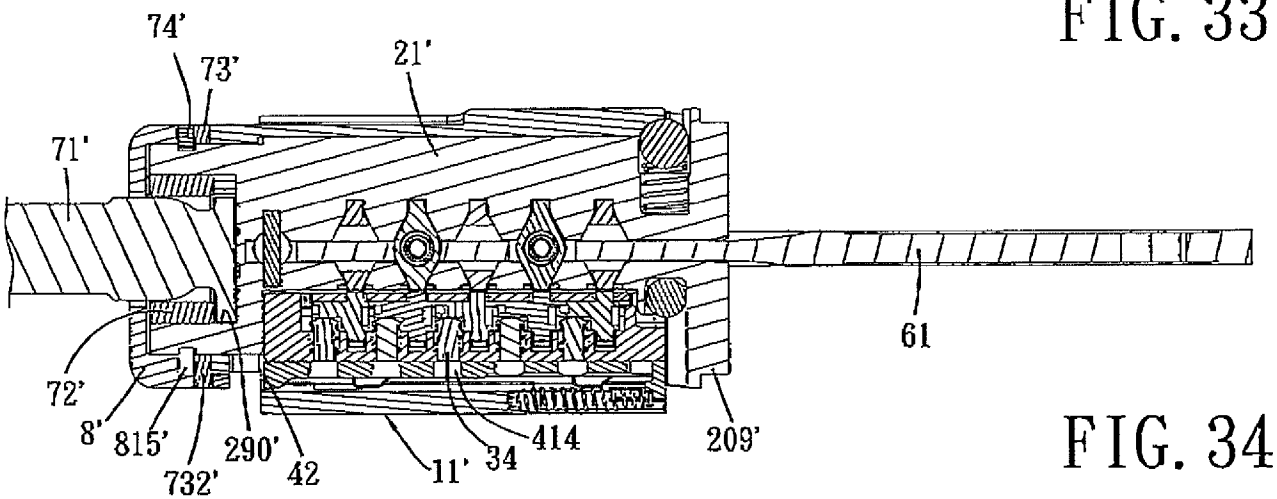
FIG. 34 is the same view as FIG. 31 but showing that the limit member is not aligned with the rear end of the control member.

Referring to FIGS. 32 to 34, the first key 61 is inserted into the plug 21' so that the detent elements 34 retract from the detent slots 414. When the first key 61 is rotated by an angle, the first transmission part 290' drives the first driven part 711' to rotate the transmission plate 71' so that the second transmission parts 712' moves the second driven parts 814'. Thus, the limit member 812' of the end cap 8' is moved circumferentially away from the rear end of the control member 41' to a non-limiting position which is not aligned with the rear end of the control member 41'. In this situation, the plug 21' can be rotated in an opposite direction without moving the transmission plate 71' and the limit member 812' because the first transmission part 290' moves in the opposite direction away from the first driven part 711'. As the limit member 812' is in the non-limiting position, the control member 41' can be moved rearward by pushing the security arm 418' with the tool, and the second key 62 (shown in FIGS. 22-26) can be inserted into the plug 211 to carry out a re-keying process.

Figure 35:
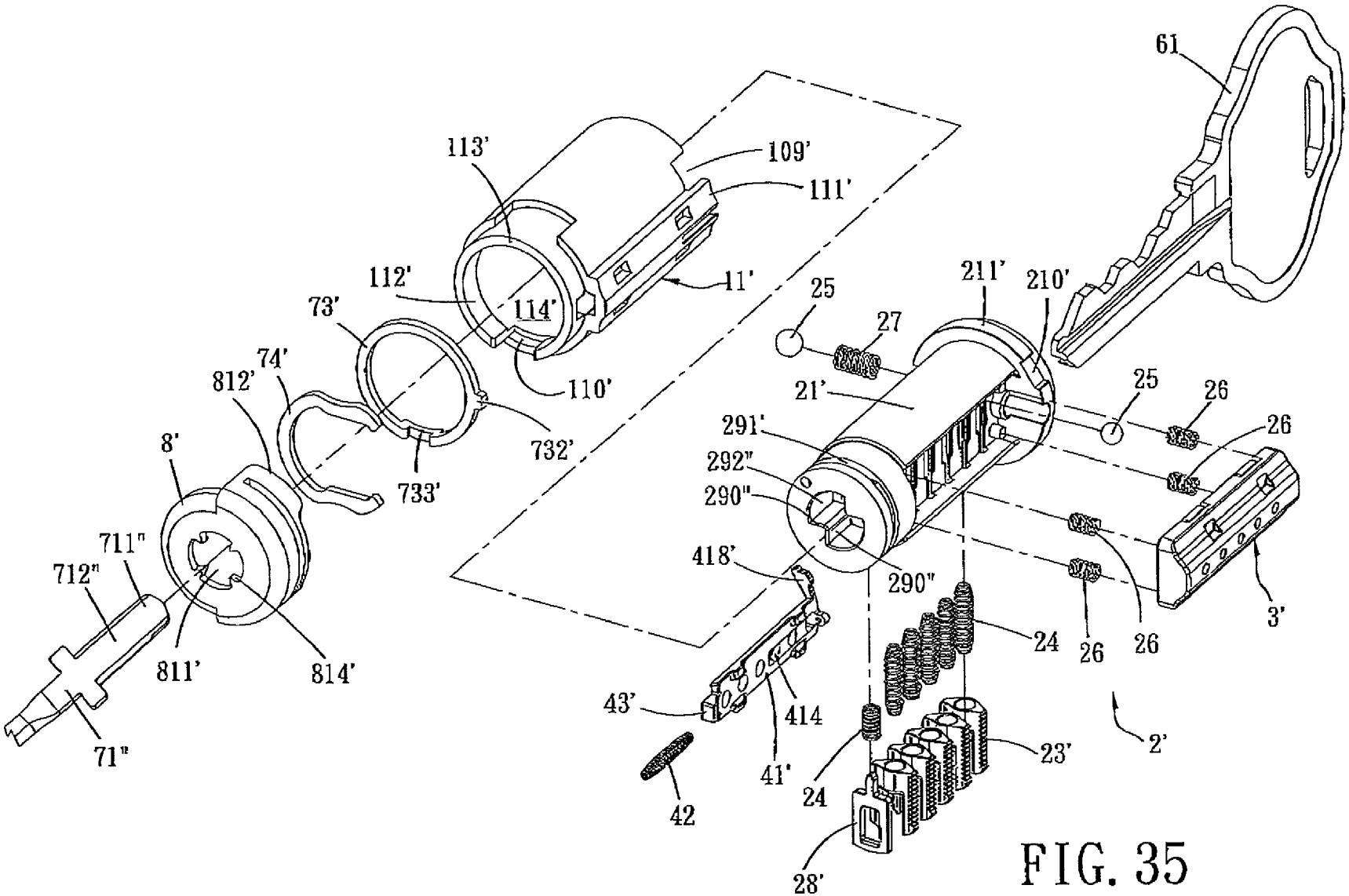
FIG. 35 is an exploded view of a re-keyable cylinder lock according to a third preferred embodiment of the present invention.

Referring to FIG. 35, the plug 21' of the cylinder lock 1' can be modified according to the third preferred embodiment of the present invention. In particular, the rear plug section 213' of the plug 21' has a rear bore 292" and first transmission parts 290" formed in the rear bore 292". The first driven part 711" of the transmission plate 71" extends into the rear bore 292" to interact with the first transmission parts 290". The second transmission part 712" interacts with the second driven parts 814'.

While the present invention has been described in connection with what are considered the most practical and preferred embodiments, it is understood that this invention is not limited to the disclosed embodiments but is intended to cover various arrangements included within the spirit and scope of the broadest interpretations and equivalent arrangements.

We claim:

1. A re-keyable cylinder lock comprising:

a lock housing defining a longitudinal axis and having a plug hole, a cavity communicated with said plug hole, and a guide hole communicated with said cavity, wherein said cavity interposes the guide hole and the plug hole;

a plug disposed within said plug hole, and including a first tumbler piece that has a toothed part;

a re-keying unit that has a gear wheel, and a gear holder holding said gear wheel, said gear wheel engaging releasably said toothed part and movable transversely of said longitudinal axis so as to engage and disengage from said toothed part; and a control member disposed inside said cavity to permit or restrict transverse movement of said re-keying unit, said control member being movable axially between a first position and a second position, said control member moving transversely to a third position when reaching said second position, said control member extending into said guide hole when moving to said third position;

said gear wheel and said gear holder moving transversely away from said toothed part when said control member moves to said third position.

2. The re-keyable cylinder lock of claim 1, wherein said control member has a guide nose that extends into said guide hole when said control member moves to said third position.

3. The re-keyable cylinder lock of claim 2, further comprising a biasing spring disposed in said cavity to bias said control member to said first position.

4. The re-keyable cylinder lock of claim 1, wherein said plug has a cylindrical outer surface that is recessed to form a groove to receive said gear holder, said gear holder has a protrusion, and said protrusion is received in said plug hole when said control member is in said first and second positions, and projects into said cavity from said plug hole when said control member is in said third position.

5. The re-keyable cylinder lock of claim 1, wherein said control member has a detent slot, said re-keying unit further having a detent element disposed in said gear holder and extendable into said detent slot, thereby preventing said plug from rotating relative to said lock housing.

6. The re-keyable cylinder lock of claim 5, wherein said re-keying unit further has a cam portion connected coaxially to said gear wheel so as to push said detent element into said detent slot.

7. The re-keyable cylinder lock of claim 6, wherein said re-keying unit further has a detent spring loaded on said detent element and biasing said detent element to move to said cam portion.

8. The re-keyable cylinder lock of claim 1, wherein said plug further includes a second tumbler piece, said lock housing further having a retaining hole proximate to said second tumbler piece, said second tumbler piece being biased to extend into said retaining hole, thereby preventing said plug from rotating relative to said lock housing.

9. The re-keyable cylinder lock of claim 1, wherein said lock housing further has a retaining hole proximate to said plug hole;

said plug further including a key hole, and a second tumbler piece that is disposed near an end of said key hole;

said second tumbler piece having a central aperture for extension of a key, a retaining pin disposed on one side of said central aperture, a spring sleeved around said retaining pin, and an engaging end opposite to said retaining pin and biased by said spring to engage said retaining hole of said lock housing, thereby preventing said plug from rotating relative to said lock housing.

10. A re-keyable cylinder lock, comprising:

a lock housing;

a plug disposed in said lock housing and having a first tumbler piece that has a toothed part;

a re-keying unit engaging said toothed part and movable to disengage from said toothed part; and a control member disposed inside said lock housing to permit or restrict a movement of said re-keying unit, said control member having a security arm that projects from a front end of said control member near a front end of said lock housing, and that is operable manually through said front end of said lock housing to move said control member so that said re-keying unit is permitted to disengage from said toothed part, said security arm being breakable to separate from said front end of said control member, thereby preventing an external force from reaching said control member.

11. The re-keyable cylinder lock of claim 10, wherein said front end of said lock housing has a front notch proximate to said security arm, said security arm projecting circumferentially from said front end of said control member into said front notch of said lock housing.

12. The re-keyable cylinder lock of claim 10, wherein:

said lock housing further has a plug hole receiving said plug, and a cavity receiving said control member proximate to said plug hole;

said plug includes a front end flange, a rear plug section, and a middle plug section that is disposed between said front end flange and said rear plug section and that has said first tumbler piece;

said control member is movable axially and rearwardly within said cavity, and has a rear end exposed from said cavity; and said re-keyable cylinder lock further comprises a limit member to limit said control member from moving rearwardly.

13. The re-keyable cylinder lock of claim 12, further comprising an end cap sleeved around said rear plug section and having said limit member formed thereon, said end cap being rotated by said plug to move between a limiting position in which said limit member is aligned with said rear end of said control member to prevent rearward movement of said control member, and a non-limiting position in which said limit member is not aligned with said rear end of said control member.

14. The re-keyable cylinder lock of claim 13, wherein said end cap has a surrounding wall around said rear plug section and formed with an arc-shaped slot extending around said rear plug section, and said re-keyable cylinder lock further comprises a guide piece connected to said lock housing and projecting into said arc-shaped slot.

15. The re-keyable cylinder lock of claim 14, further comprising a fixing ring non-rotatably sleeved around said rear plug section within said surrounding wall and abutting against a rear end of said lock housing, said fixing ring having said guide piece projecting into said arc-shaped slot.

16. The re-keyable cylinder lock of claim 15, wherein said lock housing further has a rear notch formed at a rear end of said lock housing, said fixing ring having an ear portion engaged in said rear notch so that said fixing ring is limited from rotation.

17. The re-keyable cylinder lock of claim 16, further comprising an open, locking ring disposed between said surrounding wall and said rear plug section, said surrounding wall having an inner surface formed with an annular cap groove, said rear plug section having an outer surface formed with an annular plug groove, said annular cap and plug grooves cooperatively receiving said locking ring.

18. The re-keyable cylinder lock of claim 13, further comprising a transmission rod inserted into said rear plug section and said end cap, said rear plug section having a first transmission part, said transmission rod having a first driven part driven by said first transmission part, and a second transmission part, said end cap having a second driven part driven by said second transmission part.

19. A re-keyable cylinder lock comprising:

a lock housing defining a longitudinal axis and having a plug hole, and a cavity communicated with said plug hole;

a plug disposed within said plug hole, and including a first tumbler piece that has a toothed part;

a re-keying unit engaging releasably said toothed part and movable transversely of said longitudinal axis to disengage from said toothed part; and a control member disposed in said cavity to permit or restrict transverse movement of said re-keying unit, said control member being movable axially between a first position and a second position within said cavity, said control member moving transversely to a third position when reaching said second position;

wherein said re-keying unit moves transversely away from said toothed part when said control member moves transversely, and said control member is disposed outside said plug and does not rotate along with said plug.

20. The re-keyable cylinder lock of claim 19, wherein said lock housing further has a guide hole communicated with said cavity and distal from said plug hole, said control member having a guide nose that moves transversely into said guide hole when said control member is in said third position.

21. The re-keyable cylinder lock of claim 19, further comprising a biasing spring disposed in said cavity to bias said control member to said first position.

22. The re-keyable cylinder lock of claim 19, wherein said re-keying unit has a gear wheel to engage releasably said toothed part, and a gear holder holding said gear wheel, said gear wheel and said gear holder moving transversely away from said tooth part when said control member moves to said third position.

23. A re-keyable cylinder lock comprising:

a lock housing defining a longitudinal axis and having a plug hole, and a cavity communicated with said plug hole;

a plug disposed within said plug hole, and including a first tumbler piece that has a toothed part;

a re-keying unit having a gear wheel engaging releasably said toothed part; and a control member disposed in said cavity to control said re-keying unit, said control member being movable axially between a first position and a second position within said cavity, said control member moving transversely to a third position when reaching said second position;

wherein, when said control member moves transversely to said third position, said gear wheel and said toothed part make a relative movement in a direction transverse to said longitudinal axis and disengage from each other; and wherein said control member is disposed outside said plug and does not rotate along with said plug.

* * * * *